US007027761B2

(12) United States Patent
Koetsuka et al.

(10) Patent No.: US 7,027,761 B2
(45) Date of Patent: Apr. 11, 2006

(54) DEVELOPING DEVICE AND AN IMAGE FORMING APPARATUS INCLUDING THE SAME

(75) Inventors: Kyohta Koetsuka, Kanagawa (JP); Tsuyoshi Imamura, Kanagawa (JP); Sumio Kamoi, Tokyo (JP); Noriyuki Kamiya, Kanagawa (JP); Kenji Narita, Kanagawa (JP); Kenzo Tatsumi, Kanagawa (JP); Mieko Kakegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 53 days.

(21) Appl. No.: 10/793,281

(22) Filed: Mar. 5, 2004

(65) Prior Publication Data

US 2004/0234299 A1 Nov. 25, 2004

(30) Foreign Application Priority Data

Mar. 7, 2003 (JP) ..... 2003-062128

(51) Int. Cl.
*G03G 15/09* (2006.01)

(52) U.S. Cl. ..... 399/277; 399/267

(58) Field of Classification Search ..... 399/267, 399/274, 275, 277, 282
See application file for complete search history.

(56) References Cited

U.S. PATENT DOCUMENTS 5,212,344 A * 5/1993 Kageyama et al. ..... 399/274
5,970,294 A 10/1999 Narita et al.
6,070,038 A 5/2000 Imamura et al.
6,085,062 A 7/2000 Mizuishi et al.
6,112,042 A 8/2000 Imamura et al.
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,198,895 B1 3/2001 Tsuda et al.
6,266,501 B1 7/2001 Mizuishi et al.
6,287,246 B1 9/2001 Yoshii et al.
6,330,415 B1 12/2001 Imamura et al.

(Continued)

*Primary Examiner*—G. Bradley Bennett
(74) *Attorney, Agent, or Firm*—Oblon, Spivak, McClelland, Maier & Neustadt, P.C.

(57) ABSTRACT

A developer carrier for an SLIC developing system includes a developing sleeve and a magnetic roll having a plurality of magnetic poles. A narrow development nip is formed by narrowing the width of a development pole forming a magnet brush and by narrowing a developer rising region in a developing region where a flux density attenuation ratio of the development pole is 40% or more. A half-value width of the flux density of the development pole is 22° or less and the flux density variation rate is 4.0 mT/Deg or more in a circumferential direction in a part where the flux density in at least half of that of a downstream side of a developer carrying direction from a peak magnetic force position of the development pole is 90% or less.

21 Claims, 22 Drawing Sheets

U.S. PATENT DOCUMENTS 6,337,957 B1 1/2002 Tamaki et al.
6,379,759 B1 4/2002 Kamoi et al.
6,449,452 B1 * 9/2002 Kai ..... 399/267
6,522,855 B1 2/2003 Katoh et al.
6,628,903 B1 9/2003 Ohori et al.
6,665,511 B1 12/2003 Takeuchi et al.
6,697,593 B1 2/2004 Imamura et al.
2003/0039487 A1 * 2/2003 Ikeguchi ..... 399/277
2004/0028428 A1 * 2/2004 Sugihara ..... 399/267
2004/0126147 A1 * 7/2004 Kondo et al. ..... 399/277
2004/0190946 A1 * 9/2004 Enoki et al. ..... 399/267
2004/0258431 A1 * 12/2004 Suzuki ..... 399/103
2005/0135843 A1 * 6/2005 Kakegawa et al. ..... 399/277

* cited by examiner

FIG. 4

| | HALF-VALUE WIDTH | IMAGE QUALITY RANK |
|---|---|---|
| SLIC DEVELOPING ROLLER A | 21° | 4.0 |
| SLIC DEVELOPING ROLLER B | 19° | 3.5 |
| CONVENTIONAL DEVELOPING ROLLER | 53° | 2.5 |

FIG. 18

| | HALF-VALUE WIDTH | DOWNSTREAM SIDE Min. FLUX DENSITY VARIATION RATE [ mtT/Deg ] | RANK OF OMISSION OF TRAILING EDGE |
|---|---|---|---|
| EMBODIMENT 1 | 22° | 5.2 | 4.0 |
| EMBODIMENT 2 | 22° | 6.0 | 4.5 |
| COMPARISON EX.1 | 21° | 1.9 | 2.5 |

FIG. 22

| | HALF-VALUE WIDTH | DOWNSTREAM SIDE Min. FLUX DENSITY VARIATION RATE | FLUX DENSITY OF POLE FOR DEVELOPMENT | IMAGE QUALITY RANK | CARRIER DEPOSITION RANK | REMARKS |
|---|---|---|---|---|---|---|
| COMPARISON EXAMPLE 2 | 53° | 3.5mT/Deg | 100mT | 2.5 | 3.5 | NON-SLIC |
| COMPARISON EXAMPLE 3 | 23° | 4.8mT/Deg | 109mT | 4.0 | 4.0 | CLOSE TO SLIC |
| COMPARISON EXAMPLE 4 | 20° | 3.7mT/Deg | 122mT | 3.5 | 4.5 | SLIC |
| EMBODIMENT 3 | 21° | 4.4mT/Deg | 117mT | 4.5 | 4.0 | SLIC |
| EMBODIMENT 4 | 20° | 4.8mT/Deg | 133mT | 5.0 | 5.0 | SLIC |

DEVELOPING DEVICE AND AN IMAGE FORMING APPARATUS INCLUDING THE SAME

BACKGROUND OF THE INVENTION

1. Field of the Invention

The present invention relates to a developer carrier including a developing roller for developing an electrostatic latent image on an image carrier such, as a photoconductive member, a developing device using the developer carrier, a process cartridge comprising the developing device, and a copier, facsimile apparatus, printer, plotter or similar image forming apparatus including these developing device or the process cartridge.

2. Description of the Background Art

In an image forming apparatus of an electrophotographic or electrostatic recording system including a copier, facsimile apparatus, printer or plotter, in general, an electrostatic latent image corresponding to image data is formed on an image, such as a drum-like or belt-like photoconductive member; the latent image on the image carrier is developed by a developer in a developing device as a toner image; the toner image is directly transferred to a sheet as a recording material, or transferred to the sheet via an intermediate transfer member; and the transferred image is fixed on the sheet by a fixing device. As a developing system in such an image forming apparatus, recently, a magnet brush developing system is widely employed. This system uses a two-component developer made up of toner and magnetic carrier in order to improve image of transferring property, reproducibility of the halftone, the stability of the developing characteristics against temperature and humidity.

A developer carrier including the developing roller used for the developing device of the magnetic brush developing system comprises a cylindrically formed developing sleeve and a magnetic body or a magnetic roller including magnets, disposed within the developing sleeve to form a magnetic field for generating the rise of the developer on the surface of the developing sleeve. The magnetic carrier of the developer rises on the developing sleeve along the line of magnetic force generated by the magnetic roller, and a charged toner adheres to the raised magnetic carrier. The magnets of the magnetic roller for forming a plurality of magnetic poles are formed into a rod-like shape. A pole for development, i.e., a main pole of development for raising the developer, is provided at an area corresponding to the developing region on the surface of the developing sleeve, namely the range where the magnet brush rises on the developer carrier and in contact with the image carrier. Movement of at least one of the developing sleeve and magnetic roller causes the developer rising on the surface of the developing sleeve to move toward the developing region.

The developer transported to the developing region rises along the line of magnetic force emitted from the above-mentioned pole for development and a chain-like raised developer deflectingly comes into contact with the surface of the image carrier. Then, the chain-like developer rubs the latent image on the image carrier on the basis of the relative linear speed difference with the image carrier so that the toner in the developer develops the latent image to make it a toner image.

In such a magnet brush developing system using a two-component developer since the linear speed of the developing sleeve for transporting the developer is to be set faster than the linear speed of the image carrier, a phenomenon that the rear end part of the image becomes pale or a phenomenon of the omission of the trailing edge of the image occurs. This is caused by the fact that the development is delayed in relation to the change of the latent image because the movement of the toner in the developer toward the thickness direction of the developer in the developing region takes time.

As disclosed in Japanese Patent Laid-Open Publication No. 2001-27849, in a developing device of the magnet brush developing system using a two-component developer, phenomena such as omission of the trailing edge of an image, thinning of a line or un-uniformity of the dots can be avoided by shortening a development gap while narrowing a nip for development, and by forming a uniform, short and dense magnet brush without lowering the developing capacity, uniformity, and contamination of the background. Actually, the density of the magnet brush is heightened and the development gap is shortened by narrowing a width of the nip for development and generating the uniform developing electric field. As a result, the moving time of the toner of the magnet brush from the image carrier side to the developer carrier side is reduced when the magnet brush rubs the non-image area on the image carrier in the developing region. Further, a narrow width of the nip for development is obtained by narrowing the width of the pole for development of the magnet in the developing sleeve, and thinning the rising region of the developer. The publication, in addition, proposes a construction with 40% or more of an attenuation ratio of a flux density in a normal direction of the pole for developing of the magnet roller, a nip width of 2 mm or less, and the development gap of 400 μm or less.

The developing system forming a uniform, short and dense magnet brush with narrowed width of the nip and shortened development gap is referred to as an SLIC (Sharp Line Contact magnetic brush development), and the developing device using this developing system is referred to as an SLIC developing device.

In this SLIC developing device, a developing roller as developer carrier has, for example, an attenuation ratio of 40% or more of a flux density in a normal direction (hereinafter referred to as a flux density) of the pole for development, preferably 50% or more. For attaining this attenuation ratio, the pole for development composed with a half-value width of 22° or lower, preferably 21° or lower is used. The half-value width means an angle width indicating a half value of the maximum normal magnet force of the magnetic force distribution curve in the normal direction or the peak flux.

In the SLIC developing device, such a rise of short and dense magnetic brush can be obtained by using such a developing roller so that the width of the nip for development can be narrowed, the movement of the toner to the image carrier can be suppressed, and the lowering of the developing capacity due to the narrow width of the nip for development can be avoided by the dense developing brush.

However, the following problems occur in the developing roller mentioned above:

(1) A proper half-value width varies with the outer diameter of the developing roller.

(2) A difference occurs in the image quality rank, even with the same half-value width. Or, even if the half-value width is narrow, the image quality is degraded from that of a wide roller case.

The above problem (1) is considered to be caused by the fact that the larger the outer diameter of the developing roller is, the wider the width of the nip for development is, with the same half-value width. As for the problem (2), the developing roller normally rotates with a peripheral speed about 1.5 to 2.5 times of that of the image carrier. Therefore, the development of the electrostatic image electrically formed on the latent image carrier, is started at the upstream side of the contact point with the magnet brush.

Since the developer in the magnet brush rubs over the toner once developed, the contribution of the state of the magnet brush at the downstream side of the contact-completion point of the magnet brush with the latent image carrier is considered to be large.

SUMMARY OF THE INVENTION

It is an object of the present invention to clearly define the characteristic values capable of providing a high quality image faithful to the latent image by using a developing roller as a developer carrier in the SLIC developing system.

Another object of the present invention is to make clear the characteristic values contributing to form high quality image that cannot be covered in the SLIC developing system.

Another object of the present invention is to provide a developer carrier having a high magnetic force and at a low manufacturing cost.

Another object of the present invention is to provide a developer carrier having a high image quality and at a low manufacturing cost.

Another object of the present invention is to provide a developer carrier having construction advantageous against carrier deposition while keeping the high-image quality.

Another object of the present invention is to provide a developing system and a developing device using the above-mentioned developer carrier.

Another object of the present invention is to provide a process cartridge equipped with the above-mentioned developing device.

Another object of the present invention is to provide an image forming apparatus equipped with the above-mentioned developing device or the process cartridge, and capable of forming a high quality image.

In accordance with the present invention, there is provided a developer carrier which comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less. The flux density variation rate in the circumferential direction is 4/0 mT/Deg or more in a part where the flux density in at least half of the downstream side of the developer carrying direction from the peak magnetic force position of said pole for development is 90% or lesse.

In accordance with the present invention there is also provided a developing system for visualizing a latent image on a latent image carrier by forming a magnet brush with the developer raised on a developer carrier and by rubbing said latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

In accordance with the present invention, there is also provided a developing device equipped with a developer carrier for carrying and transporting the developer, forming a magnet brush with the developer raised on the developer carrier, and visualizing a latent image on a latent image carrier by rubbing the latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of said pole for development is 40% or more. The half-value width of the flux density of the pole for development is 22° or less, and the flux density variation rate in the circumferential direction is 4.0 mT/Deg or more in a part where the flux density in at least the half of the downstream side of the developer carrying direction from the peak magnetic force position of the pole for development is 90% or less.

In accordance with the present invention, there is also provided a process cartridge used for an image forming part of the image forming apparatus, detachably installed to the apparatus main body and integrally equipped with at least the latent image carrier and the developing device in the cartridge. The developing device is equipped with a developer carrier for carrying and transporting the developer, forming a magnet brush with the developer raised on the developer carrier, and visualizing a latent image on a latent image carrier by rubbing the latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

In accordance with the present invention, there is also provided a process cartridge used for an image forming part of the image forming apparatus, detachably installed to the apparatus main body, and integrally equipped with at least the latent image carrier, the charging device for charging said latent image carrier, the developing device and the cleaning device for cleaning the latent image carrier in the cartridge. The developing device is equipped with a developer carrier for carrying and transporting the developer, forming a magnet brush with the developer raised on the developer carrier, and visualizing a latent image on a latent image carrier by rubbing the latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

In according with the present invention, there is also provided an image forming apparatus for forming the latent image on the latent image carrier, visualizing the latent image on the latent image carrier with the developer of the developing device, then transferring the image on the latent image carrier to the recording material, and fixing to form the image. The developing device is equipped with a developer carrier for carrying and transporting the developer, forming a magnet brush with the developer raised on the developer carrier, and visualizing a latent image on a latent image carrier by rubbing the latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of said pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

In accordance with the present invention, there is also provided an image forming apparatus for forming the latent image on the latent image carrier. The apparatus visualizes the latent image on the latent image carrier by developing with the developer of the developing device, transfers the image on the latent image carrier to the recording material, and fixes to form the image. A process cartridge is used for an image forming part of the image forming apparatus, detachably installed to the apparatus main body and integrally equipped with at least the latent image carrier and the developing device in the cartridge. The developing device is equipped with a developer carrier for carrying and transporting the developer, forming a magnet brush with the developer raised on the developer carrier, and visualizing a latent image on a latent image carrier by rubbing said latent image carrier with said magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

In accordance with the present invention, there is also provided an image forming apparatus for forming a latent image on the latent image carrier. The apparatus visualizes the latent image on the latent image carrier by developing with the developer of the developing device, transfers the image on the latent image carrier to the recording material and fixes to form the image. A process cartridge is used for an image forming apparatus, detachably installed to the apparatus main body, and integrally equipped with at least the latent image carrier, the charging device for charging the latent image carrier, the developing device and the cleaning device for cleaning the latent image carrier in the cartridge. The developing device is equipped with a developer carrier for carrying and transporting the developer, forming a magnet brush with the developer raised on the developer carrier, and visualizing a latent image on a latent image carrier by rubbing the latent image carrier with the magnet brush. The developer carrier comprises a developing sleeve for carrying and transporting the developer and a magnetic roll disposed within the developing sleeve and having a plurality of magnetic poles. The width of the pole for development forming the magnet brush by raising the developer in the developing region facing the latent image carrier is narrowed, and narrowing the rising region of the developer in the developing region to realize a narrow nip for development, and the flux density attenuation ratio of the pole for development is 40% or more. The half-value width of the flux density of the pole for development is 22° or less, and the flux density variation rate in the circumferential direction is 4.0 mT/Deg or more in a part where the flux density in at least half of the downstream side of the developer carrying direction from the peak magnetic force position of the pole for development is 90% or less.

BRIEF DESCRIPTION OF THE DRAWINGS

The above and other objects, features and advantages of the present invention will become more apparent from the following detailed description taken with the accompanying drawings in which:

FIG. 4 shows the relation of the half-value width related to the respective developing rollers shown in FIGS. 1–3 with the image quality rank;

FIG. 18 shows the relation among the half-value width, flux density variation rate and rank of the omission of the trailing edge of an image of the developing rollers of the embodiments 1, 2 and the comparative example 1;

FIG. 22 shows the relations among the half-value width, flux density variation rate, flux density of the poles for development, image rank, and carrier deposition rank in the embodiments 3, 4 and the comparative examples 2 to 4.

DESCRIPTION OF THE PREFERRED EMBODIMENT(S)

Firstly, the magnetic force distribution, or the flux density distribution in the normal direction of the developing roller as the developer carrier used in the above-mentioned SLIC developing system will be described below.

Figure 1:
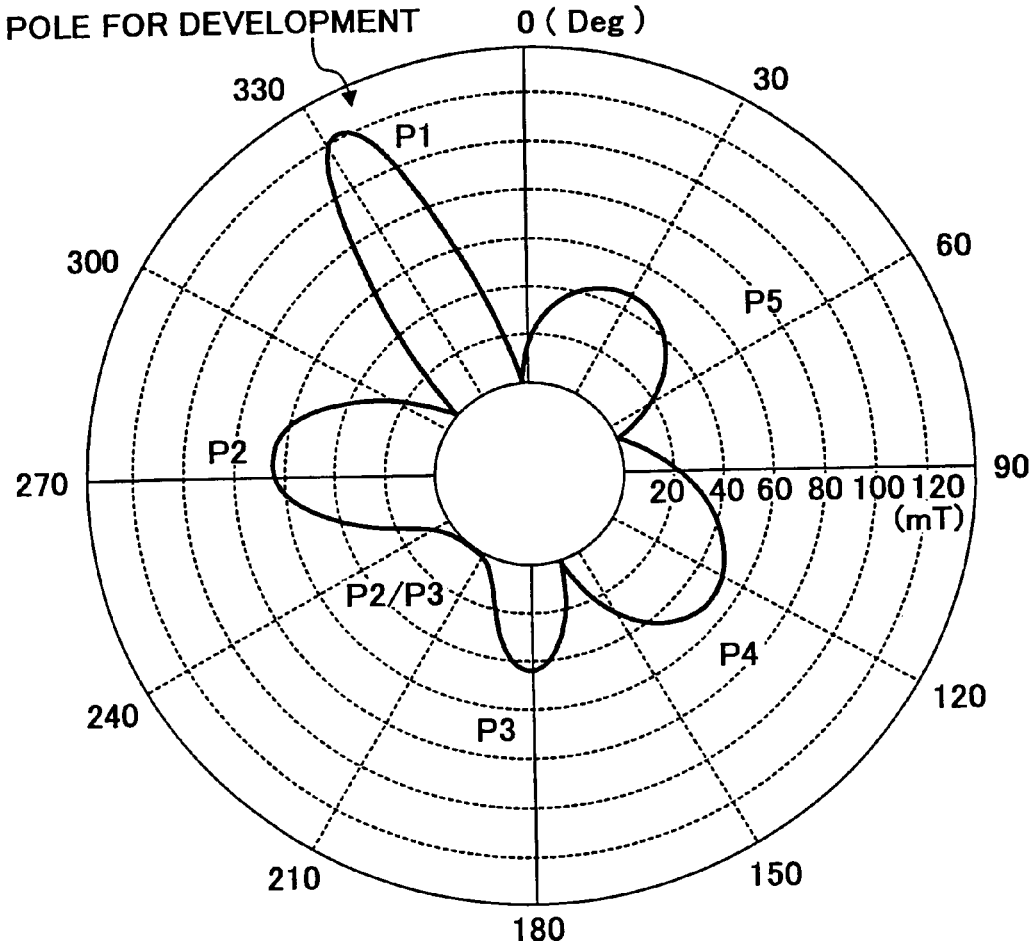
FIG. 1 shows an example of a magnetic force distribution (flux density distribution) in the normal direction of a developing roller A for the SLIC developing.
Figure 2:
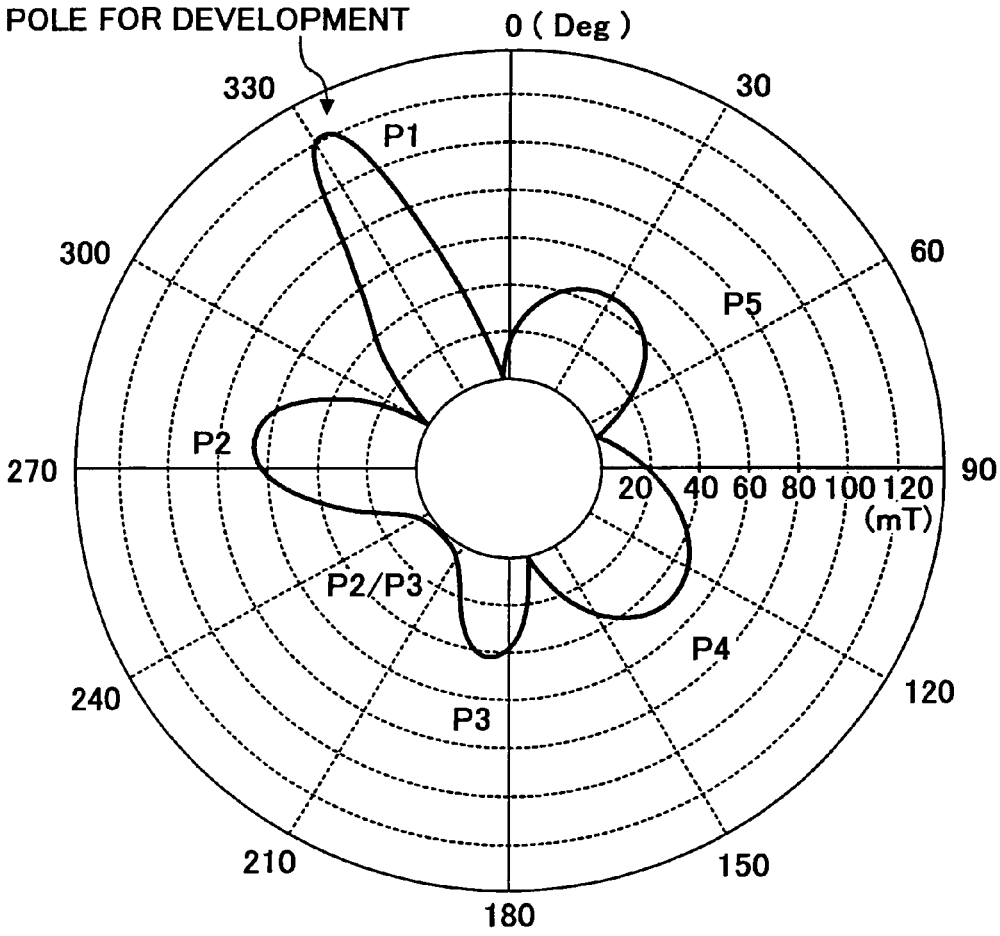
FIG. 2 shows another example of a magnetic force distribution (flux density distribution) in the normal direction of a developing roller B for the SLIC developing.
Figure 3:
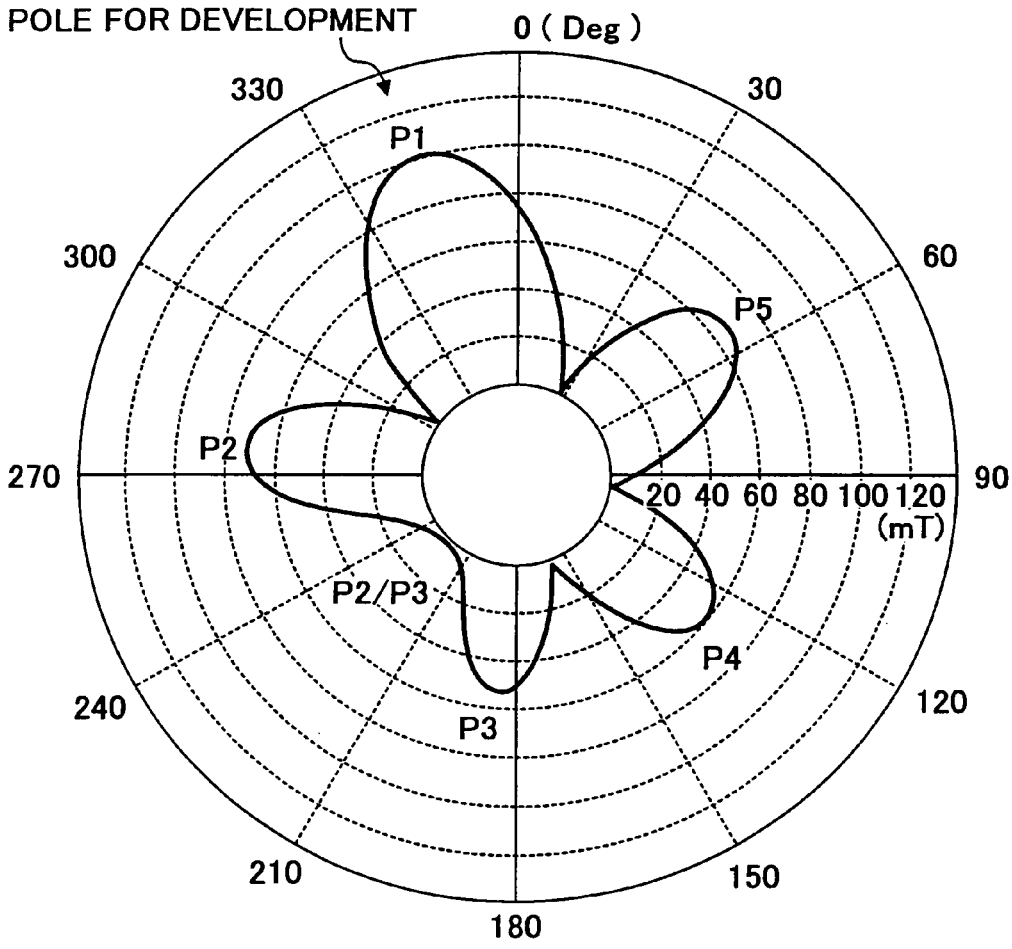
FIG. 3 PRIOR ART
FIG. 3 shows an example of a magnetic force distribution (flux density distribution) in the normal direction of a developing roller with a wide nip for development in the prior art.

FIGS. 1 and 2 respectively show the magnetic force distributions, or the flux density distributions in the normal direction of two types of an SLIC developing roller A and an SLIC developing roller B used in the SLIC developing system, and FIG. 3 shows the magnetic force distribution, or the flux density in the normal direction of a conventional developing roller with a wide nip for development. FIG. 4 shows the relations between the half-value width and image quality rank of the SLIC developing rollers A and B and a conventional developing roller. An external diameter of a sleeve of each developing roller is Φ20 mm, the magnet roller has five poles P1 to P5, with P1 as a pole for development. The image quality rank is divided into nine ranks of evaluation from 1.0 to 5.0, with the rank 5 as the highest image quality.

As shown in FIG. 4, although the SLIC developing roller B has a higher image quality rank in a overall evaluation including the omission of the trailing edge of an image, thinning of line, development density and dot uniformity, compared to a conventional developing roller, the image quality rank is lower than that of the SLIC developing roller A in spite of its narrower half-value width. These SLIC developing rollers A and B have an attenuation ratio of a flux density in the normal direction of 50% or more. The relation between the half-value width and attenuation ratio of these developing rollers, therefore, cannot be clearly explained.

From these points, in the SLIC developing rollers, by clearly determining the attenuation ratio of the flux density and half-value width, a higher image quality can be provided by a dense and short magnet brush than that by a conventional developing roller. Besides, the existence of a characteristic for obtaining a high image quality faithful to the latent image can be confirmed.

The present invention will be described in detail hereinafter with reference to the accompanying drawings.

Figure 5:
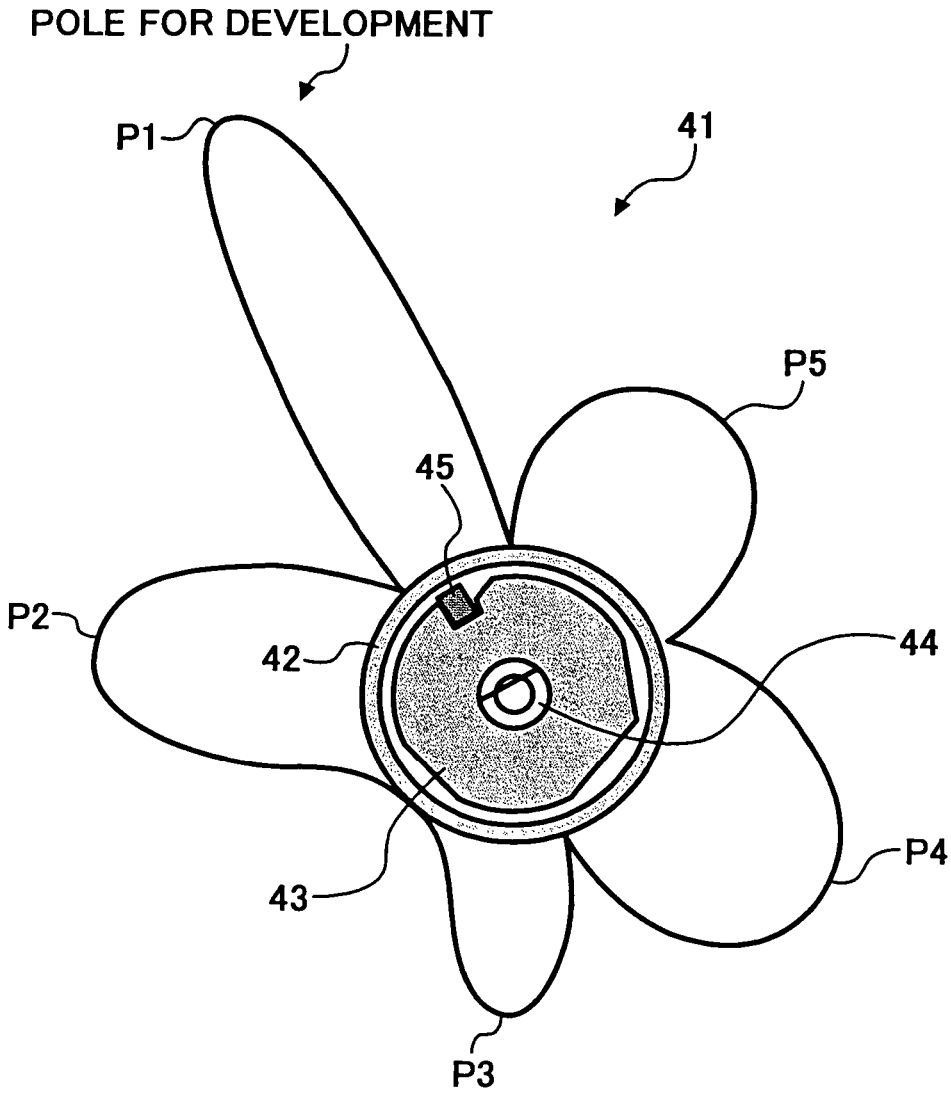
FIG. 5 shows a sectional construction and a magnetic force distribution (flux density distribution) in the normal direction of an example of the developing according to the present invention.

FIG. 5 shows the cross-sectional construction and a magnetic force distribution, or flux density distribution in the normal direction of the SLIC developing roller according to the present invention. The SLIC developing roller 41, as shown comprises a cylindrical developing sleeve 42 carrying and transporting a tow-component developer comprising a magnetic carrier and toner, and a magnet roll 43 disposed inside the developing sleeve 42 and having a plurality of magnetic poles. The magnet role 43 is an approximately cylindrical magnet roll comprising a plastic magnet formed by mixing magnetic powder with a high polymer material or rubber magnet except for the pole for development and the plurality of the magnetic poles P2 to P5 are magnetized on the magnet roll 43 except for the part of the pole for development. A core metal 44 comprising a magnetic body is inserted into the magnet roll 43, and a magnet block 45 forming the pole for development P1 is buried in and fixed to a groove part of the approximately cylindrical magnet roll 43. The magnet block 45 forming the pole for development P1 is composed of a material having a higher maximum energy product (B Hmax) than that of the cylindrical magnet role part.

In further details, the magnet roll 43 is manufactured by injection molding and extrusion molding using a mixed material of magnetic powder with high polymer material. A ferrite-based magnetic material is suitably used for the magnetic powder and a high polymer compound such as a polyamide-based material, an ethylenic compound or chlorine-based material, or rubber material is used for the high polymer material. For the magnet block 45 forming the pole for development P1, rare earth-based magnet, plastic magnet formed by mixing rare earth-based magnet powder with the high polymer material similar to the above one, or rubber magnet is suitably used.

Though the above case is an example of burying the magnet block 45 in the groove part of the approximately cylindrical magnet roll 43 as the pole for development, the magnet roll 43 may be formed as a single body of a magnet roll of approximately cylindrical shape comprising of plastic magnet formed by mixing magnetic powder with a high polymer material, or rubber magnet, and a plurality of magnetic poles including a pole for development are magnetized, as an alternative constitution.

Figure 6:
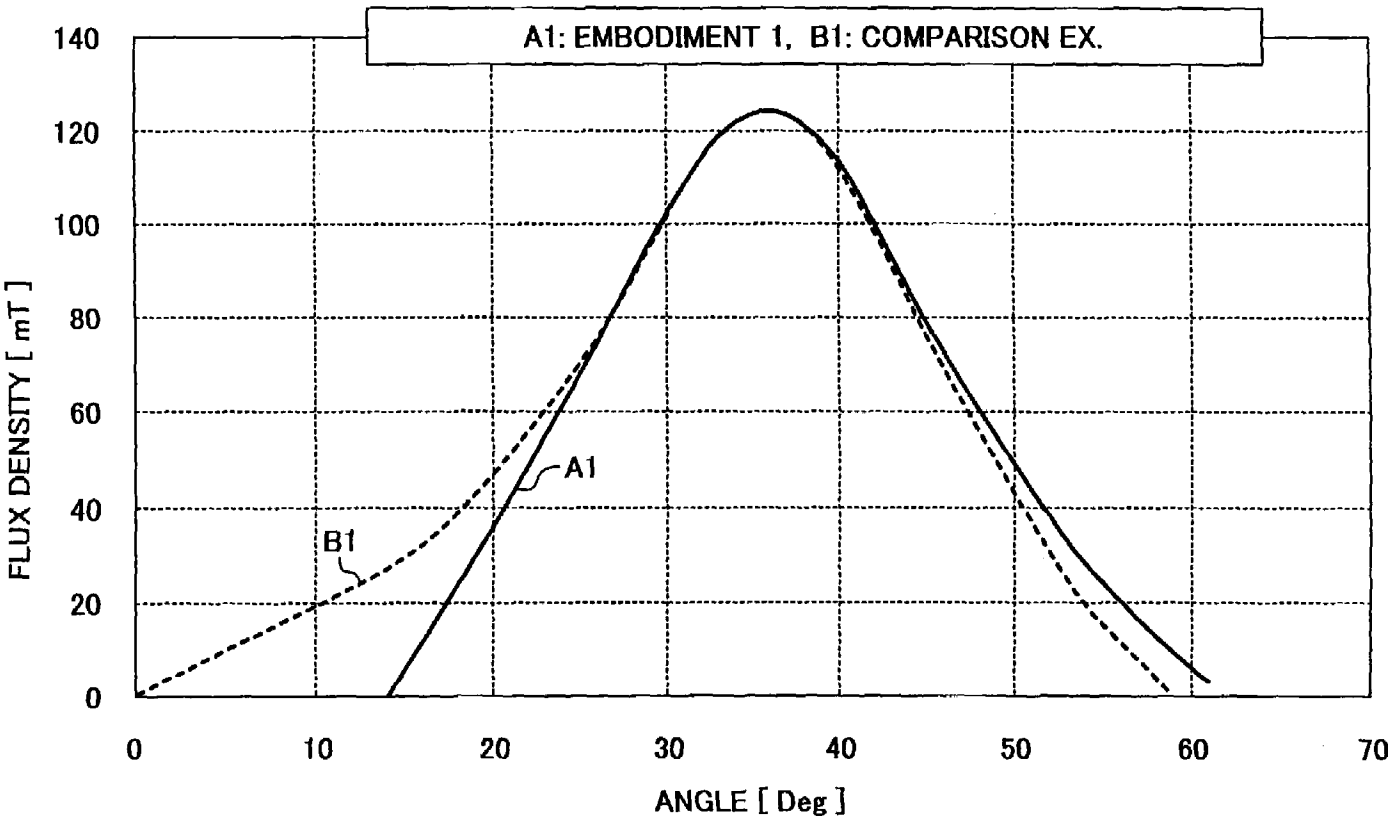
FIG. 6 shows a flux density distribution in the normal direction of a pole for development of the developing roller of an embodiment 1 of the present invention and a conventional SLIC developing roller as a comparative example.
Figure 7:
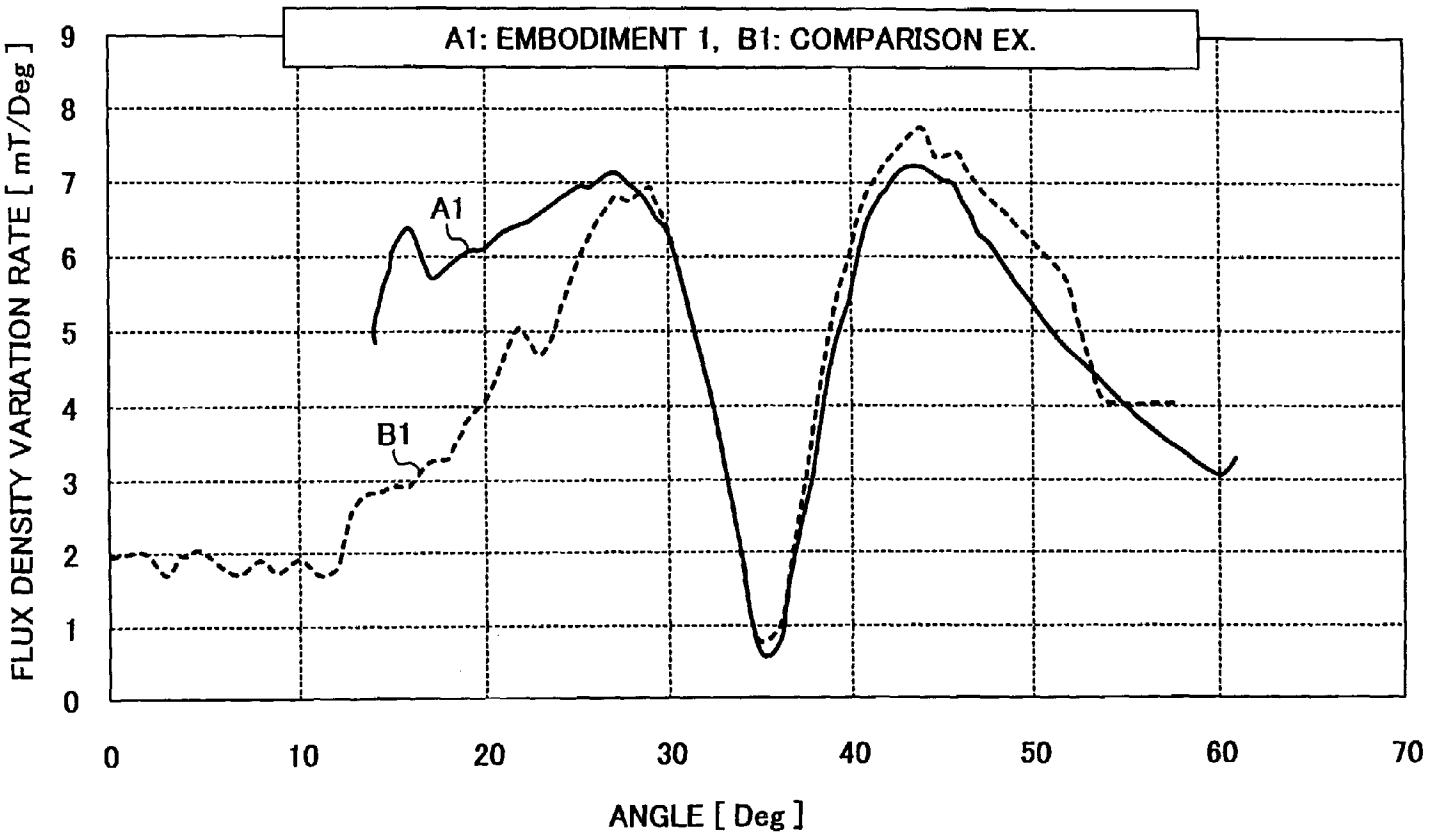
FIG. 7 shows a flux density variation rate of the pole for development of the developing roller of the embodiment 1 of the present invention and the comparative example.

FIGS. 6 and 7 show the flux density distribution in the normal direction and the flux density variation rate of the poles for development of developing rollers of a the embodiment 1 of the present invention and of the comparative example, or of the conventional SLIC developing roller, respectively. The half-value width of the pole for development of developing roller of the present embodiment 1 of the present invention and that of the comparative example is 22°. The left side of the peak position of the flux density is the downstream side of the developer transporting direction in FIGS. 6 and 7.

The difference between the developing roller of the present embodiment 1 and that of the comparative example lies in the flux density variation rate of the downstream side of the poles for development, as shown in FIG. 7. That is, the flux density variation rate in the normal direction in the circumferential direction of a part with the flux density 90% or less in the downstream side in the developer transporting direction from the peak magnetic force position of the pole for development, is 2 mT/Deg in the developing roller of the comparative example, while that of the developing roller of the present embodiment 1 is 5 mT/Deg or more. The result of comparison and verification by mounting these developing rollers on the developing device of the constitution shown in FIG. 8 is explained below.

Figure 8:
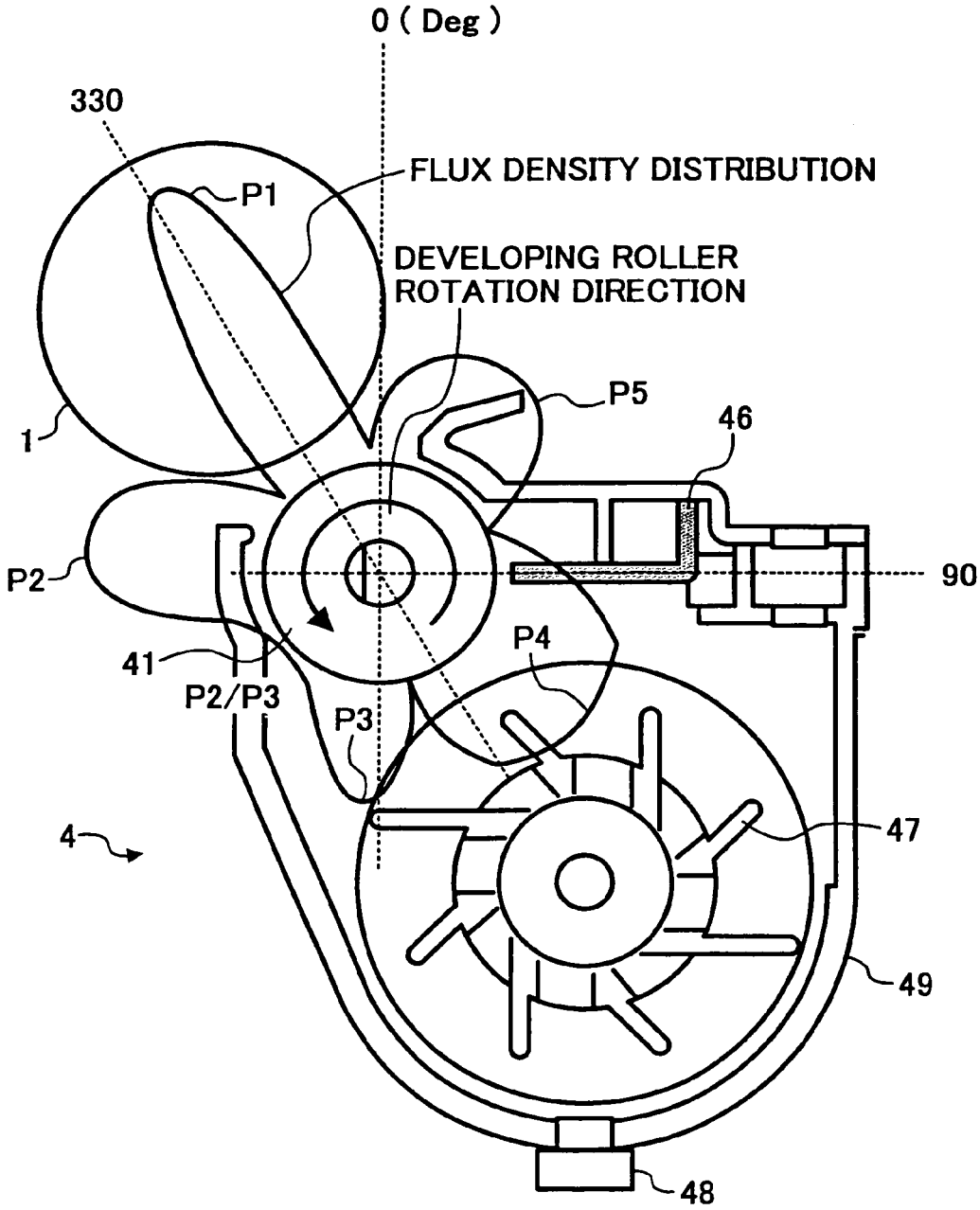
FIG. 8 is a cross-sectional view showing an example of a schematic construction of the developing device according to the present invention.

A schematic constitution of the developing device related to the present invention is shown in FIG. 8. This developing device 4 includes, as shown, a developing roller 41 carrying and transporting a two-component developer comprising a magnetic carrier and toner, a doctor blade 46 regulating a layer thickness and quantity of the developer carried by the developing roller 41, a developer agitating screw 47 for agitating and mixing the two-component developer comprising the magnetic carrier and toner, a developing case 49 housing these members, and a toner density sensor 48 for detecting the toner density in the developer. The developing roller 41 of the developing device 4 is disposed close to a photoconductive drum 1 serving as an image carrier, and the pole for development is provided roughly in the facing position to the drum 1. In further details, the pole for development is provided so that the peak magnetic force position of the pole for development of developing roller 41 is situated in the upstream side of the developer transporting direction of the position where the developer comes closest to the drum 1 to be developed. The developing sleeve of the developing roller 41 is rotated in the arrow direction (counter-clock wise) in the figure, carrying the developer, and develops the latent image with the toner to form a toner image, by rubbing the raised magnet brush raised at the pole for development against the drum 1.

In the developing device 4 of such a construction of the present embodiment 1, since the developing roller 41 of the SLIC developing system is used, the width of the nip for development is narrowed to shorten moving time of the toner of the magnetic brush from the drum 1 side to the developing roller 41 side, when the magnet brush rubs a non-image part on the drum 1 in the developing region.

Also, a density of the magnet brush is heightened in order to make uniform a developing field and supplement lowering of contact probability of the developer caused by narrowing the width of the nip for development. In the SLIC developing roller of the present embodiment 1, the flux variation rate near the peak of the pole for development is high, which causes small and quick rising width of rising and falling of the magnet brush, therefore, a dense brush can be formed. In the developing roller of the present embodiment 1, since the flux density variation rate in the normal direction in the circumferential direction of a part where the flux density is 90% or less in the half portion of the downstream side toward the developer transporting direction from the peak magnetic force position of the pole for development, is 5 mT/Deg or more, the movement of the magnet brush, or falling is fast, improving the image quality by preventing the omission of trailing edge.

However, in the developing roller of the comparative example 1, since the flux density variation rate in the normal direction in the circumferential direction is as low as 2 mT/Deg, even though the attenuation ratio near the peak is large, the variation rate near the half-value is small, the movement (fall) of the magnet brush is slow compared to that near the peak position, and a dense brush is not formed, the image quality like the omission of trailing edge is inferior to that of the developing roller of the present embodiment 1.

Figure 9:
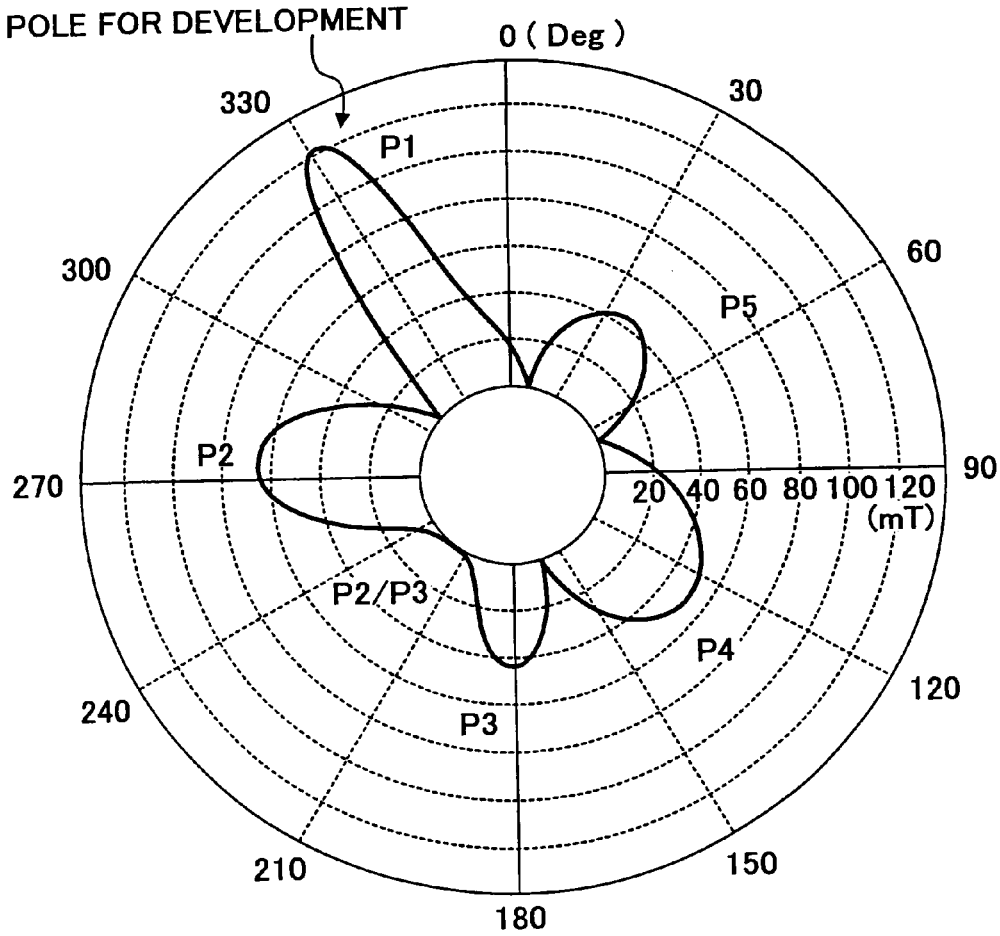
FIG. 9 shows an example of a flux density distribution of a developing roller of an embodiment 2 of the present invention.
Figure 10:
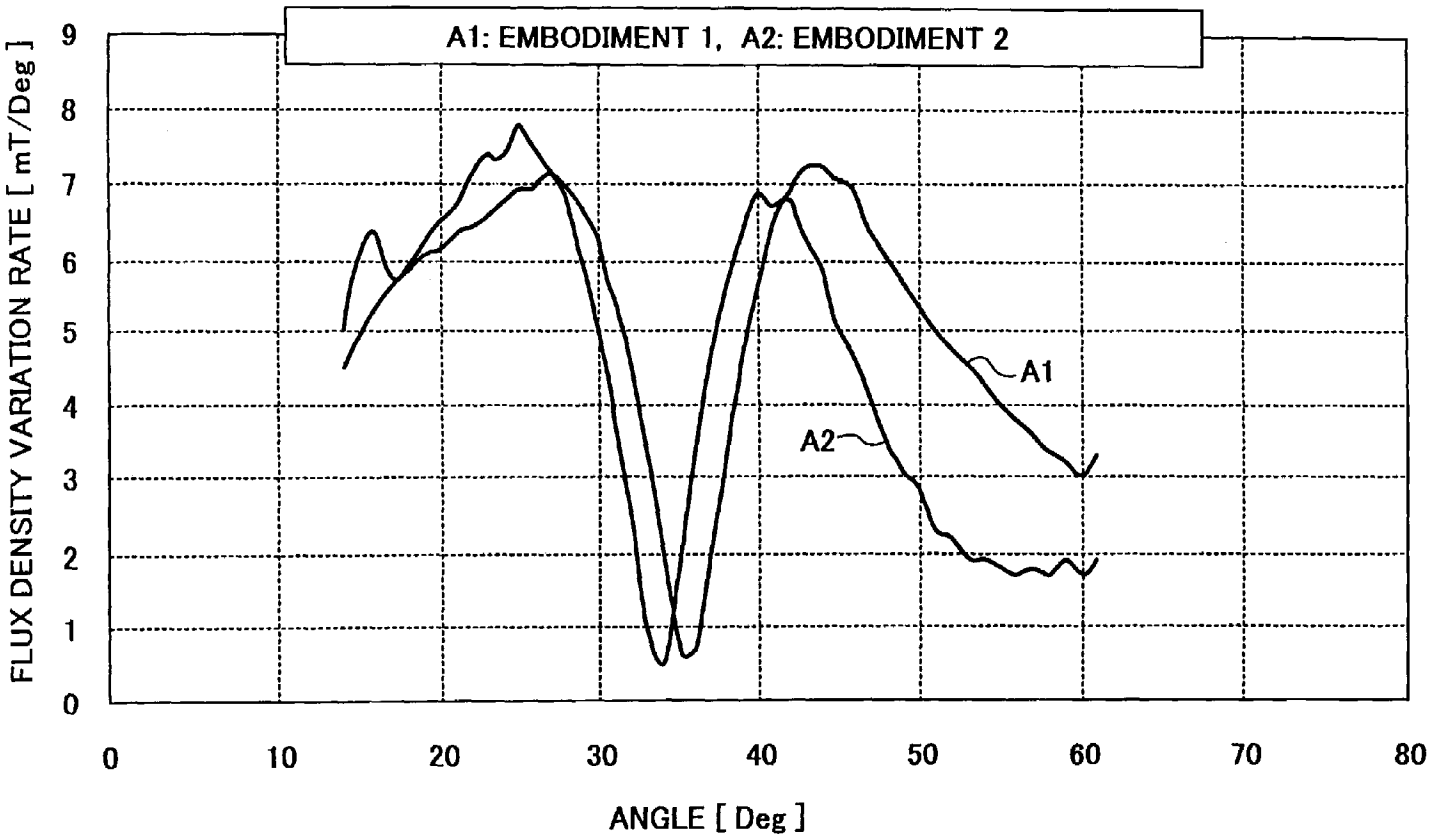
FIG. 10 shows a flux density variation rate of the pole for development of the developing roller of the embodiments 1 and 2 of the present invention.

Next, FIG. 9 shows an example of the flux density distribution of the developing roller of an embodiment 2 of the present invention. FIG. 10 shows the flux density variation rate of the pole for development. The embodiment 1 shown as A1 shows the same flux density variation rate as that in the A1 in FIG. 7, and the embodiment 2 shown as A2 shows the flux density variation rate of the pole for development with the magnetic force distribution, or the flux density distribution shown in FIG. 9.

In the developing roller of the embodiment 2, the angle between two pole transition points of the magnet poles adjacent to the both sides of the pole for development is 50° or more, and the pole for development has a part where the flux density variation rate in the normal direction in the circumferential direction is 2 mT/Deg in the upstream side of the developer transporting direction. The half-value width of the developing roller of the embodiment 2 is also 22°, and is same as that of the developing rollers of the embodiment 1 and the comparative example. At this time, the image rank in the case of using the developing roller of the embodiment 1 is equivalent to that in the case of using the developing roller of the embodiment 2. Since the magnet brush is coarse when it passes through the developing region, in the upstream side where the variation rate is small, toner easily moves to the magnet brush from the drum. In the part where the toner finally comes into contact with the latent image on the drum in the downstream side in the developer transporting direction, the flux density variation rate in the normal direction in the circumference direction is 4 mT/Deg or more, and the magnet brush in the downstream side is dense, therefore, sufficient development can be performed.

As mentioned above, in the developing roller of the present invention, as the pole transition point width in the downstream side can be widened, and the flux in the adjacent downstream side can be reduced, the flux ratio of the N-pole to the S-pole can be optionally controlled in the design of a magnetic circuit of the developing roller, which is useful to obtain necessary flux density distribution.

Next, examples of the developing rollers of the present invention will be described.

Figure 11:
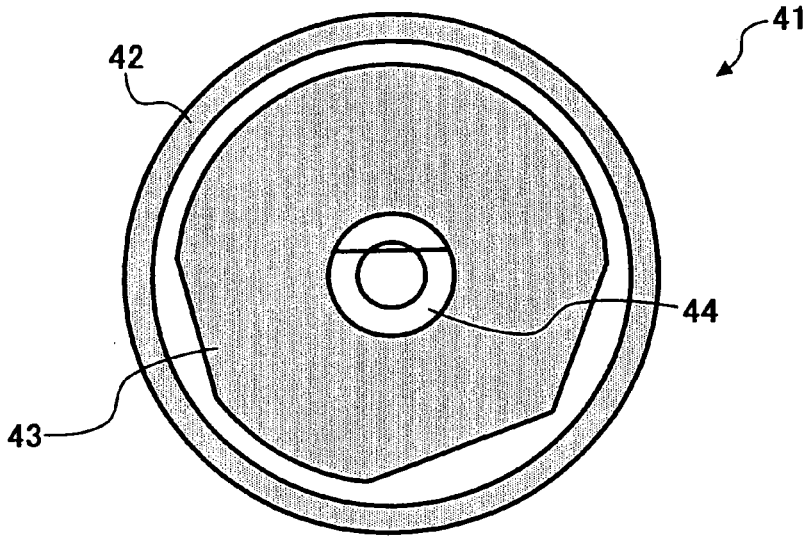
FIG. 11 is a cross-sectional view showing an example of the roller construction according to the present invention.

FIG. 11 shows a cross-sectional construction of an example of the developing roller of the present invention. The developing roller 41 comprises a cylindrical developing sleeve 42 for carrying and transporting a two-component developer comprising a magnetic carrier and toner, and a magnet roll 43 disposed in the developing sleeve 42 and having a plurality of magnetic poles. A core metal 44 composed of a magnetic body is inserted into the magnet roll 43, and is manufactured by injection molding and extrusion molding using a material comprising magnetic powder and a high polymer material. As the magnetic powder, a ferrite-based material, such as Sr ferrite or Ba ferrite, and as the high polymer material, a high polymer compound, such as a polyamide-based material, ethylenic compound or chlorine-based material or a rubber material is suitably used. Further actually, as the high polymer compound, a PA (polyamide)-based material including 6PA or 12PA, an ethyleneic compound including EEA (ethylene-ethyl copolymer), EVA (ethylene-vinyl copolymer), and a chlorine-based material including CPE (chlorinated polyethylene) are preferable. In particular, in the extrusion integral molding with inexpensive die cost and molding cost, the EEA material is preferable, above all, the EEA material having 25–35% of EA component provides a highly precise developing roller causing no bending of the core metal due to warp, as it has a superior orientation property, a high magnetic characteristic and appropriate flexibility and rigidity as well.

Figure 12:
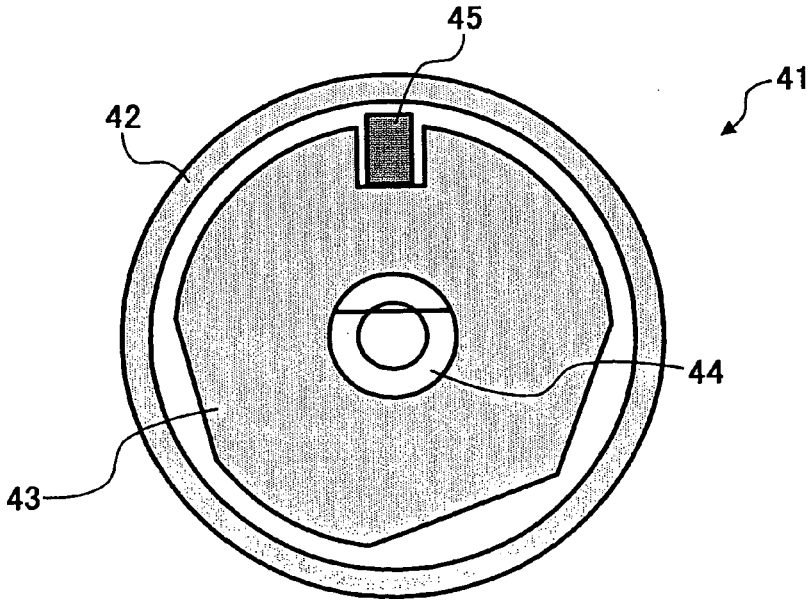
FIG. 12 is a cross-sectional view showing another example of constitution of the developing roller according to the present invention.

FIG. 12 shows a cross-sectional construction of another actual example of the developing roller of the present invention. The developing roller 41 comprises the cylindrical developing sleeve 42 for carrying and transporting the two-component developer comprising the magnetic carrier and toner, and the magnet roll 43 disposed in the developing sleeve 42 and having a plurality of magnetic poles. In this example, same as in FIG. 5, the magnet roll 43 has an approximately cylindrical shape, comprising a plastic magnet formed by mixing magnetic powder with a high polymer material or rubber magnet, except for the pole for development. A plurality of magnetic poles P2 to P5 are magnetized to the magnet roll 43 except for the part of the pole for development P1. The core metal 44 composed of a magnetic body is inserted into the magnet roll 43, and the magnet block 45 forming the pole for development P1 is buried into a groove part of the cylindrical magnet roll 43 and fixed thereto. The magnet role 45 forming the pole for development P1 is composed of a material having a maximum energy product (B Hmax) larger than that in the cylindrical magnet roll part.

Further in details, the magnet role 43 is manufactured by injection molding and extrusion molding, using a material comprising the magnetic powder and the high polymer. A ferrite-based magnetic material such as Sr ferrite or Ba ferrite is suitably used as the magnetic powder, and a high polymer compound such as a polyamide-based material, ethylenic compound or chlorine-based material, or rubber material is suitably used as the high polymer material. Actually, as the high polymer compound, a PA (polyamide)-based material such as 6PA or 12PA, an ethylenic compound, such as EEA (ethylene-ethyl copolymer), or EVA (ethylene-vinyl copolymer), or chlorine-based material, such as CPE (chlorinated polyethylene), are preferable. A rubber material like NBR can also be used.

For the magnet block 45 forming the pole for development P1, a material having a narrow width and residual magnet Br, Br>0.5 T, for obtaining a high magnetic characteristic is desirably used, and in many cases, rare earth based magnet such as Nd-based (Nd—Fe—B) or Sm-based (Sm—Co, Sm—Fe—N, Sm—Fe—B) magnet, or a plastic magnet formed by mixing powder of these rare earth-based magnets with a high polymer material similar to the above noted, or rubber magnet can be used.

By the present invention, while the flux density variation rate of the pole for development is set as shown in above FIG. 10, the flux density pattern of the adjacent magnet poles can be freely manufactured, and a low-cost developing roller can be provided compared to a magnet roller formed by forming respective magnetic poles in a block and sticking them.

Moreover, in the developing roller construction shown in FIG. 12, by constituting the groove width of the magnet roll 43 wider than that of high magnetic force magnet block 45 of the pole for development, the developing roller can be manufactured with the pole for development stably located at a desired position, by setting the fixing position of the high magnetic force magnet block 45 at a constant position in relation to the D-cut of the core metal 44, even in the case of occurrence of characteristics dispersion in the magnet roll due to reasons in the course of manufacturing.

Figure 13:
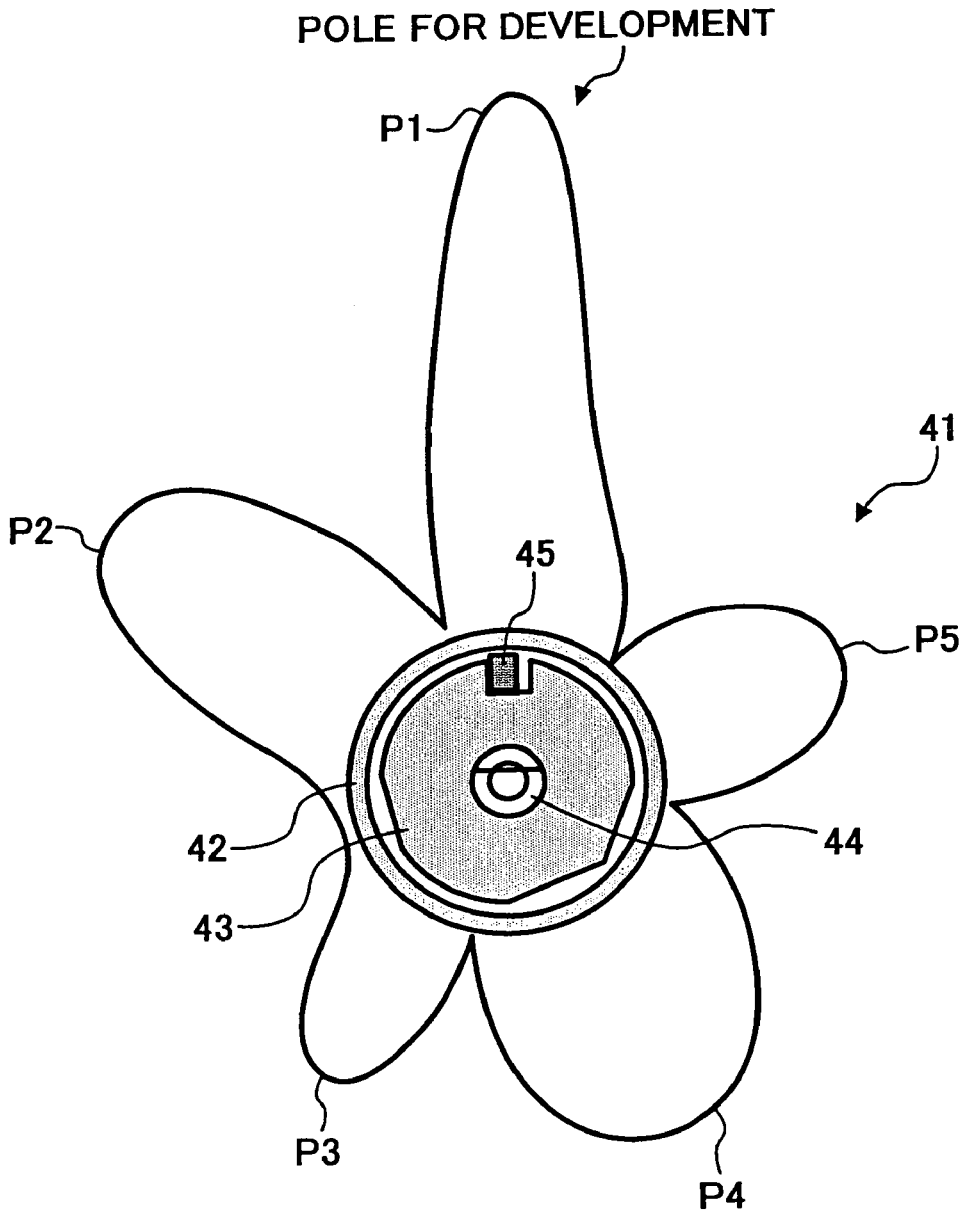
FIG. 13 shows a cross-sectional construction and a magnetic force distribution (flux density distribution) in the normal direction of other example of the developing roller according to the present invention.

Next, FIG. 13 shows a cross-sectional construction and the magnetic force distribution in the normal direction of another SLIC developing roller of the present invention.

The basic construction of this developing roller 41 is same as shown in FIG. 12. The high magnetic force magnet block 45 is constituted in such a manner that it is formed smaller than the groove part of the approximately cylindrical magnet roller 43, and the high magnetic force magnet block 45 is buried in and fixed to the downstream side in the developer transporting direction in the above groove part. By this developing roller 41, the flux density distribution of the developing roller of the before-mentioned embodiment 2, can be easily obtained. For shifting the pole transition point in the upstream side to a further upstream side, a space in the upstream side of the groove part is enlarged in relation to the magnet block 45, and flux density distribution necessary for the developing device can be optionally set.

Figure 14:
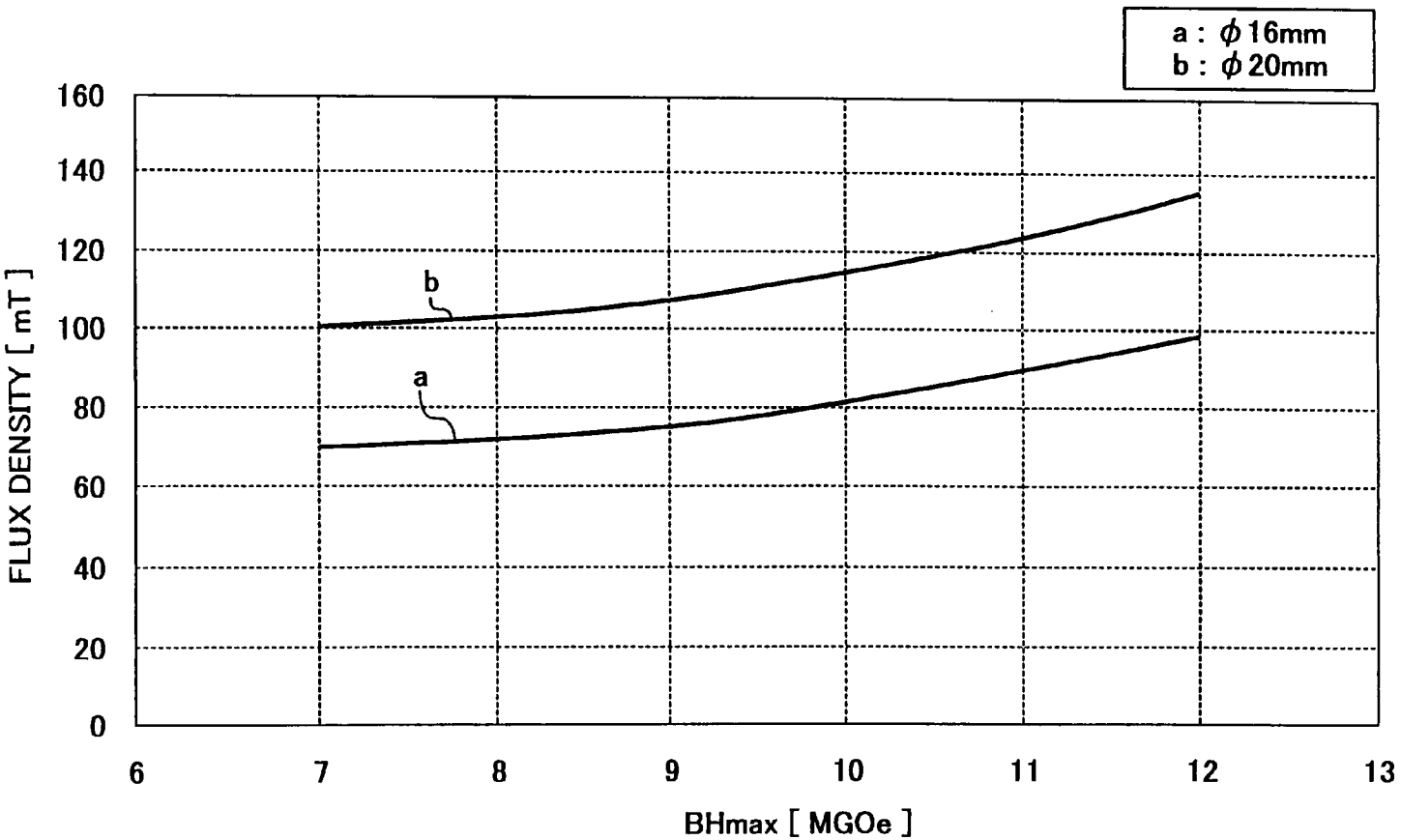
FIG. 14 shows the relation of the maximum energy product (B Hmax) of the magnet block of the developing roller with a flux density of the pole for development according to the present invention.

In the developing roller of the present invention, the rare earth-based magnet block 45 used being buried in the grooved part of the magnet roll 43, preferably has a characteristic of the maximum energy product of B Hmax=10 MGOe (1 MGOe=7.96 KJ/$m^3$) or more. Here, a relation (half-value width 20°) of the characteristic (maximum energy product: B Hmax) of the magnet block 43 to the flux density of the pole for development is shown in FIG. 14. As shown, the relation to the flux density is different depending on the diameter of the developing sleeve (a: Φ16 mm, b: Φ20 mm).

This is because the lowering amount of the flux density caused by the distance from the surface of the magnet role is different, in the case where the gaps of the magnet role 43 and the sleeve 42 are same and the diameters of the magnet rolls are different (the larger the magnet roll, the smaller the lowering rate).

Here, the faster the speed of a copier or printer as an image forming apparatus is, the faster feeding of a developer is necessary, therefore, the sleeve diameter and the number of rotation of the sleeve are needed to be increased. As a target, in many cases, the rotation speed is 300 rpm or more for the sleeve diameter of Φ16 mm, or 400 rpm or more for Φ20 mm.

The faster the rotation, the more the carrier deposition tends to occur.

Heightening of the flux density of the pole for development is effective against the carrier deposition. A flux density of 80 mT or higher at about 300 rpm of the sleeve rotation, and 100 mT or higher at about 400 rpm are preferable.

Accordingly, for attaining these flux densities, a rare earth-based magnet block 45 with 10 MGOe or higher as the maximum energy product (BHmax) is desirably used. A magnet block with 12 MGOe or higher is further preferable, for coping with the recent fining tendency of the carrier particles.

The present invention is characterized by using a developing roller 41 having the above-explained constitution and characteristics, furthermore, the position of the peak magnetic force of the pole for development P1 is desirably located in the upstream side (sleeve rotation direction) of the developer transporting direction from the closest point to the photoreceptor 1, as a constitution shown in FIG. 8.

The magnet brush bearing the developer rises highest at the nearly maximum point of the flux density in the normal direction, and becomes lowest at the nearly maximum point of the flux density in the tangential direction, together with the rotation of the sleeve. Accordingly, by employing this constitution, an image faithful to the latent image can be obtained, since a once-developed toner on the drum 1 is not strongly rubbed by the magnet brush, as the magnet brush passes in a fallen state at the closest point to the drum 1.

Moreover, since the highest position of the magnet brush is this side of the closest position of the drum, the brush slowly comes into contact, and the magnet brush starts to be low at the closest point, it also comes into contact slowly here. That is, as the magnet brush can be brought into contact uniformly and slowly in the narrow nip for development, impact applied to the magnet brush is weak, which is advantageous against the carrier deposition. In the present invention, since the width of the nip for development is narrow, besides the magnet brush abruptly falls in a short distance in the downstream side, only several degrees of tilting is effective.

A target tilting angle of 3–6° is preferable for tilting the peak magnetic force position of the pole for development P1 toward the upstream side of the developer transporting direction (sleeve rotation direction) from the closest point to the drum 1, and when the developing density is sufficient, the peak position can be disposed further upstream side.

Further, the present invention has a construction of using the developing roller of the above-explained constitution and characteristics, and using a developer comprising spherical toner and magnetic carrier.

The spherical toner is formed by a polymerization method, but not limited to it, with a particle size of 5 μm or less, preferably 3 μm or less, which provides a satisfactory image. The polymerization method includes, e.g., emulsion polymerization and suspension polymerization. By using these spherical toners and the developing roller of the present invention, as the carrier is further uniformly coated with fine particle-sized and spherical toner, the magnet brush of the pole for development can develop the latent image further faithfully, to form a high quality image.

Next, a process cartridge and an image forming apparatus equipped with it in accordance with the present invention will be described with reference to FIG. 15.

Figure 15:
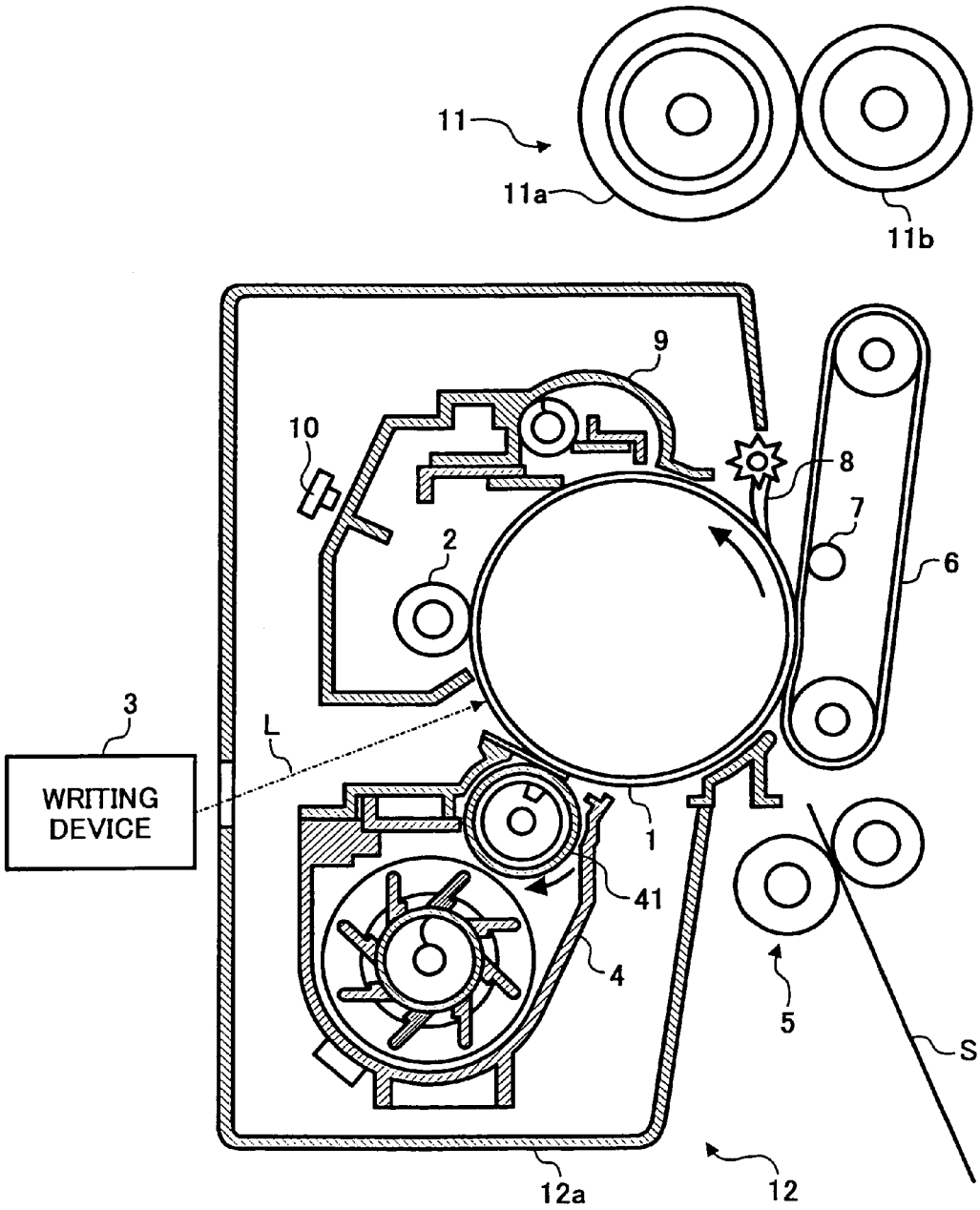
FIG. 15 shows a schematic construction of an example of the image forming apparatus equipped with a process cartridge according to the present invention.

As shown in FIG. 15, around the drum 1 serving as the latent image carrier, there are disposed a charging device 2 for uniformly charging the surface of the drum; a writing device 3 for emitting laser beam 3 corresponding to image data, for irradiating the surface of the drum to form an electrostatic latent image; a developing device 4 for depositing toner on the latent image on the drum to develop it to a toner image, or a visible image; a transfer-transport belt 6 for transferring the toner image formed on the surface of the drum 1 onto a recording material S such as a sheet and transporting the sheet S; a separation claw 8 for separating the sheet S after transferring from the drum 1; a cleaning device 9 for removing residual toner on the drum after transferring; and a discharging device 10 for discharging the residual potential on the drum, in order. In the upstream side of the sheet transporting direction of the transfer-transport belt 6, a register roller 5 is provided for sending the sheet S fed from a feeding part, not shown, at a prescribed timing. In the downstream side of the sheet transporting direction of the transfer-transport belt 6, a fixing device 11 comprising a pair of rollers, 11*a*, 11*b* for fixing an unfixed toner image transferred to the sheet S by heating or pressurizing.

In an image forming apparatus of such a construction, when an image forming is started, the surface of the drum 1 is uniformly charged with a charging roller of the charging device 2, then the surface of the drum 1 is irradiated with laser beam L from a writing device 3 corresponding to the image data, to form the electrostatic latent image. The latent image on the drum 1 is developed with a developer, or toner, carried on the developing roller 41 of the developing device 4 to form a visible image (toner image). The sheet S is fed to the nip part between the drum 1 and the transfer-transport belt 6 from a feeding part (not shown) via the register roller 5, corresponding to the timing of the formation of the toner image, and a transfer bias is applied to a bias roller 7, to transfer the toner image on the drum 1 to the sheet S.

The sheet S after transferring of the toner image is separated from the drum 1 by the separation claw 8 while being transported by the transfer-transport belt 6, and further transported toward the fixing device 11. The toner image on the sheet S is fixed by the pair of rollers 11*a* and 11*b* of the fixing device 11 and ejected to an ejected paper part (not shown). The surface of the drum 1 after transferring is cleaned by the cleaning device 9 to remove residual toner, discharged by the discharging device 10 and sent to the next image forming process.

In the image forming apparatus of a construction mentioned above, the constriction of the developing device 4 is similar to that shown in FIG. 8, and the construction and characteristics of the developing roller 41 are also same as mentioned above. This image forming apparatus, therefore, can develop the latent image faithfully using the SLIC developing system, to form a high quality image.

This image forming apparatus employs a process cartridge 12 which contains the drum 1, charging device 2, developing device 4, cleaning device 9, and discharging device 10 in one cartridge 12*a*. The process cartridge 12 is detachably constituted to the main body of the image forming apparatus, and whole the process cartridge is exchanged in the developer exchange, which facilitates maintenance. The used process cartridges are collected by a maker for reuse, having superior recycling characteristics.

Construction of the developing device shown in FIG. 8 and of the process cartridge and image forming apparatus shown in FIG. 15 show respective examples, and not limited to the construction shown in the figures.

Next, results of evaluation of comparison with comparison examples will be explained, performed by creating various types of developing rollers by changing the flux density distribution in the normal direction of the developing roller, and flux density variation rate in the downstream side of developer transporting direction from the peak magnetic force position of the pole for development, using the developing roller, developing device and image forming apparatus of the above-explained construction.

First, the evaluation result for embodiments 1 and 2 of the present invention and a comparison example 1 will be explained.

The evaluation is performed in the following conditions, using the developing roller with a construction shown in FIG. 5 and the developing device with a construction shown in FIG. 8:

developing roller diameter: Φ20 mm toner: crushed toner (average particle size 55 μm)

carrier: magnetic carrier (carrier diameter 55 μm)

The embodiments 1 and 2 of the present invention correspond to the before-mentioned embodiments 1 and 2.

Figure 16:
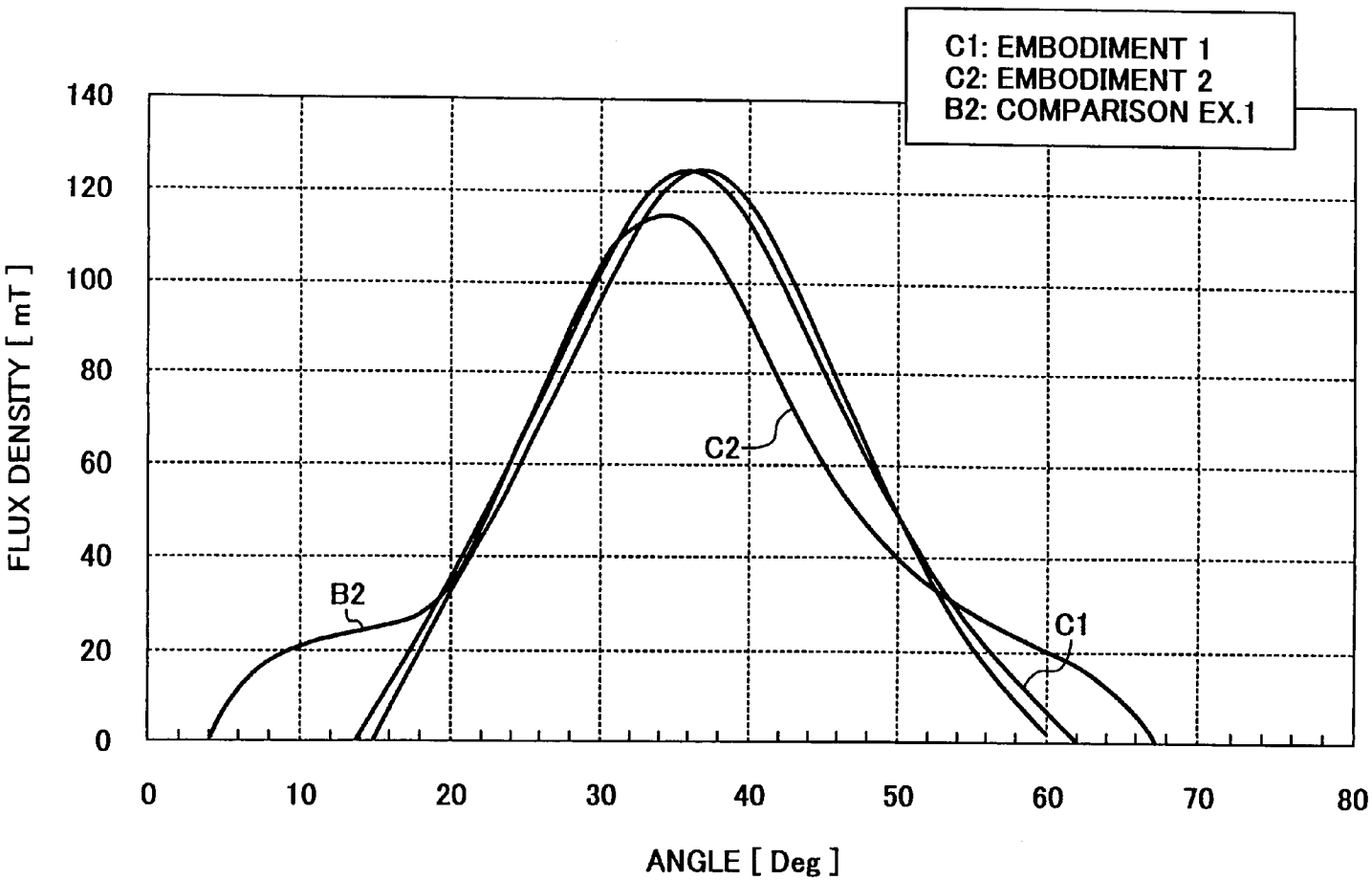
FIG. 16 collectively shows flux density distributions of the poles for development of respective developing rollers of the embodiments 1, 2 of the present invention and the comparative example 1.
Figure 17:
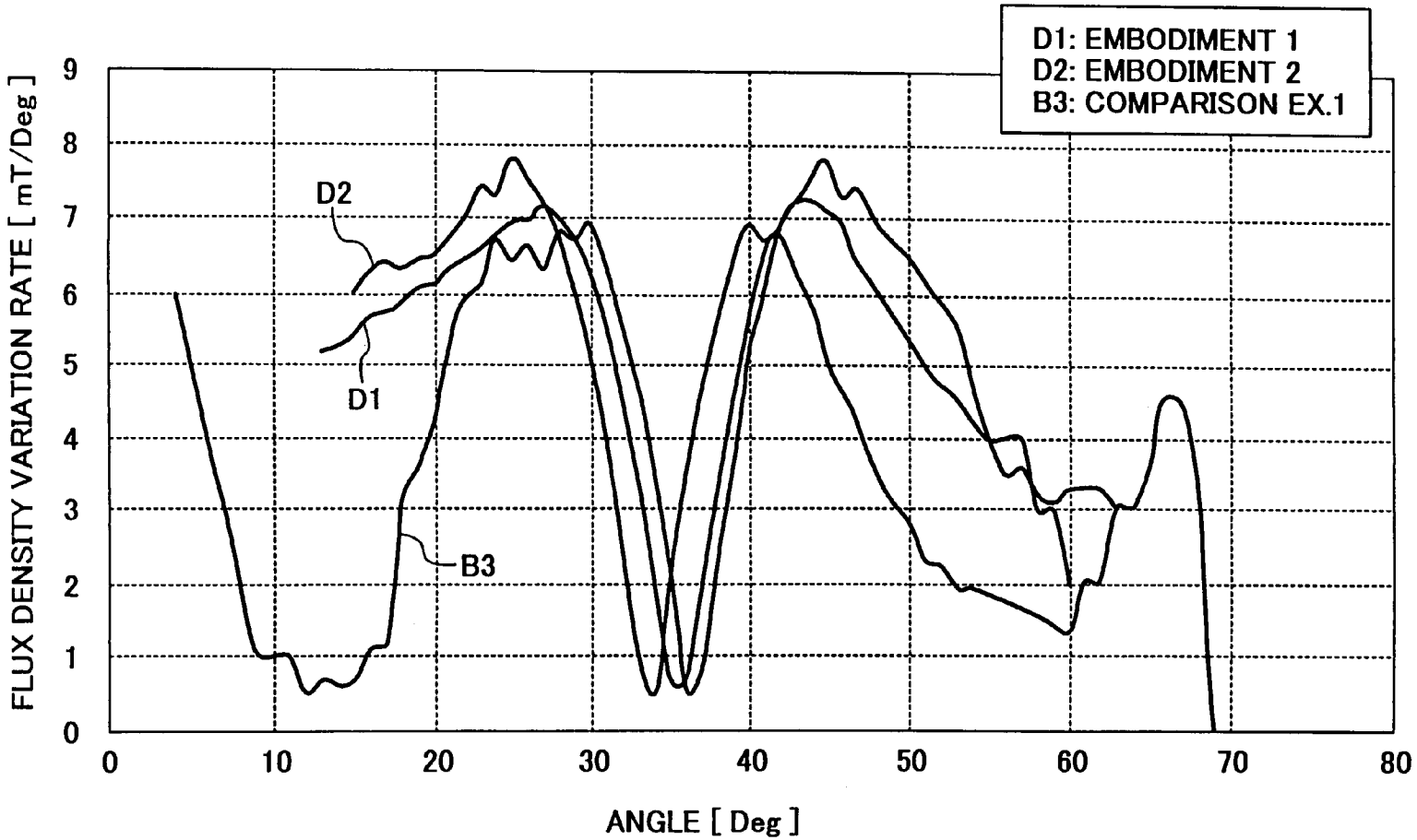
FIG. 17 collectively shows the variation rates of flux density of the poles for development of the developing rollers of the embodiments 1, 2 of the present invention and the comparative example 1.

The flux density distribution of the pole for development is as shown by the curves C1 and C2 shown in FIG. 16, and the flux density variation rate is as shown by the curves D1 and D2 shown in FIG. 17. This is an example of the developing roller satisfying the conditions of the present invention (the flux density variation rate in the normal direction is 4.0 mT/Deg or more. The flux density distribution shown by the curve B2 of FIG. 16 and the flux density variation rate shown by the curve B3 of FIG. 17 are comparison examples, and are examples of the conventional SLIC developing rollers not satisfying the conditions of the present invention. The evaluation result of comparison of the developing roller of the embodiments 1 and 2 and the developing rollers of the comparison example by using the developing device of the construction shown in FIG. 8 is shown in FIG. 18. The image is evaluated in nine ranks of 1.0 to 5.0 in the omission of the trailing edge of the image, with the rank 5.0 as the highest image quality.

As is clear from the evaluation result shown in FIG. 18, in the developing device using the developing roller having the flux density variation rate in the downstream side of the pole for development proposed in the embodiments 1 and 2 of the present invention, better images are obtained than those obtained by the developing device using the conventional developing roller of the comparison example.

Next, the evaluation result of embodiments 3 and 4 of the present invention and the comparison examples 2 to 4 will be described.

The developing roller of the comparison examples 2 to 4 with varied half-value width, flux density and flux density variation rate and the developing rollers of the embodiments 3 and 4 of the present invention are manufactured, and the image rank and the carrier deposition rank are evaluated in the following conditions, using the developing device of the construction shown in FIG. 8:

developing roller diameter: Φ20 mm toner: crushed toner (average particle size 5 μm)

carrier: magnetic carrier (carrier diameter 35 μm)

The developing roller of the comparison example 2 is of the conventional type with a wide half-value width (not SLIC) having the magnetic force distribution in the normal direction as shown in FIG. 3, having no maximum value of the flux density variation rate in the normal direction.

Figure 19A:
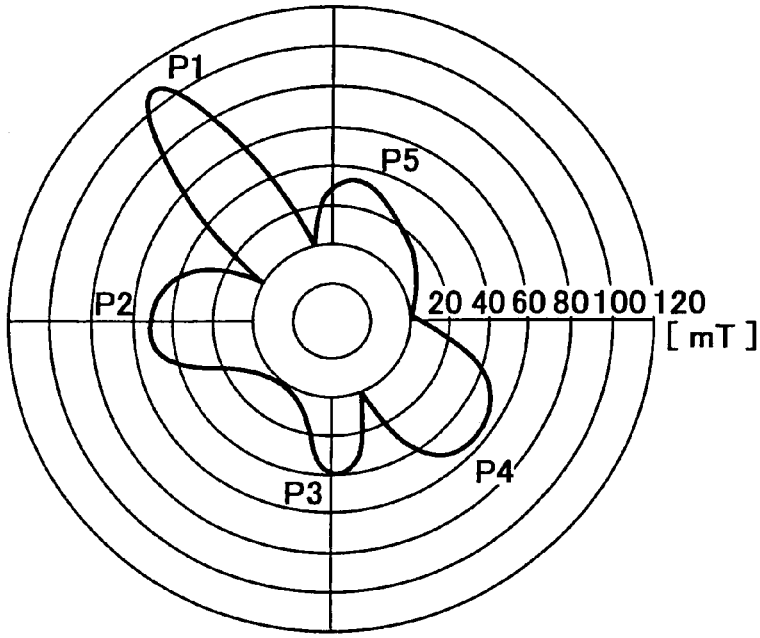
FIGS. 19A and 19B respectively show the magnet force distributions (flux density distribution) in the normal direction of comparative examples 3 and 4.
Figure 20A:
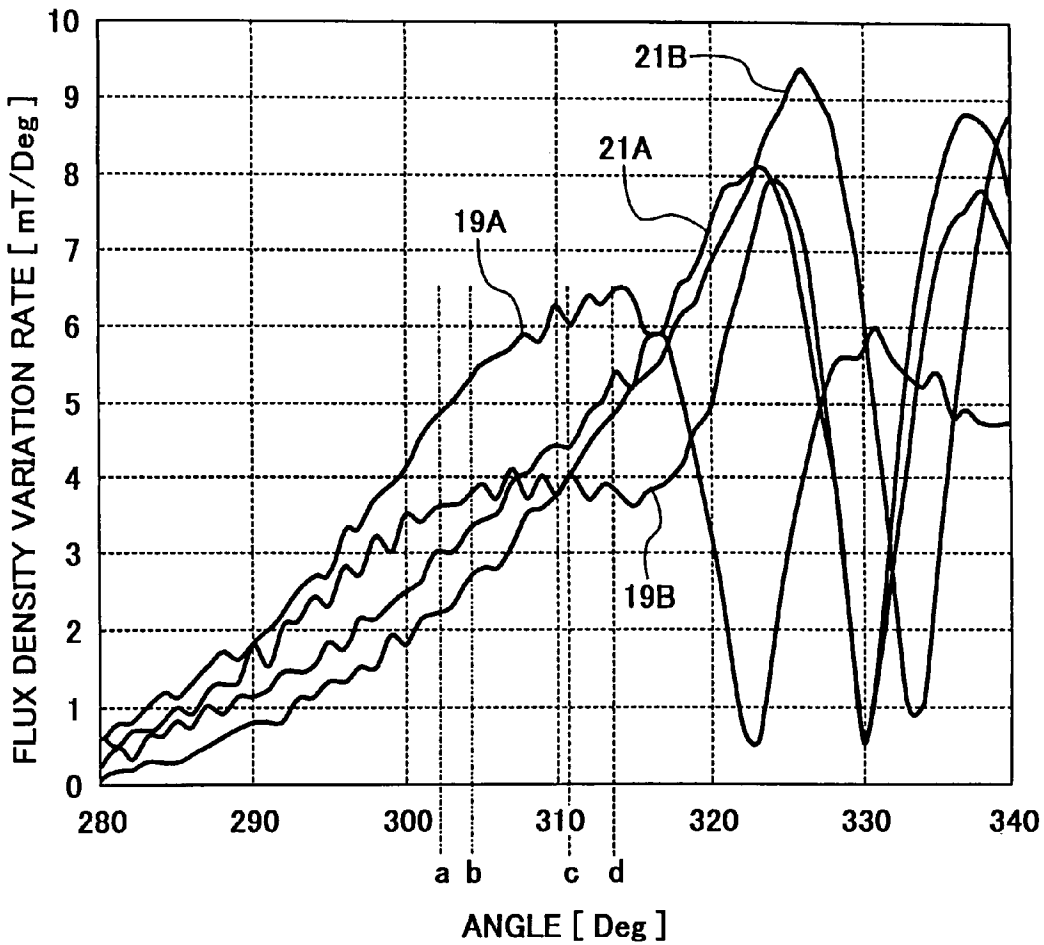
FIGS. 20A and 20B respectively collectively show the flux density variation rates of the poles for development and the flux density distributions of the poles for development of embodiments 3, 4 of the present invention and the comparative examples 3, 4.
Figure 20B:
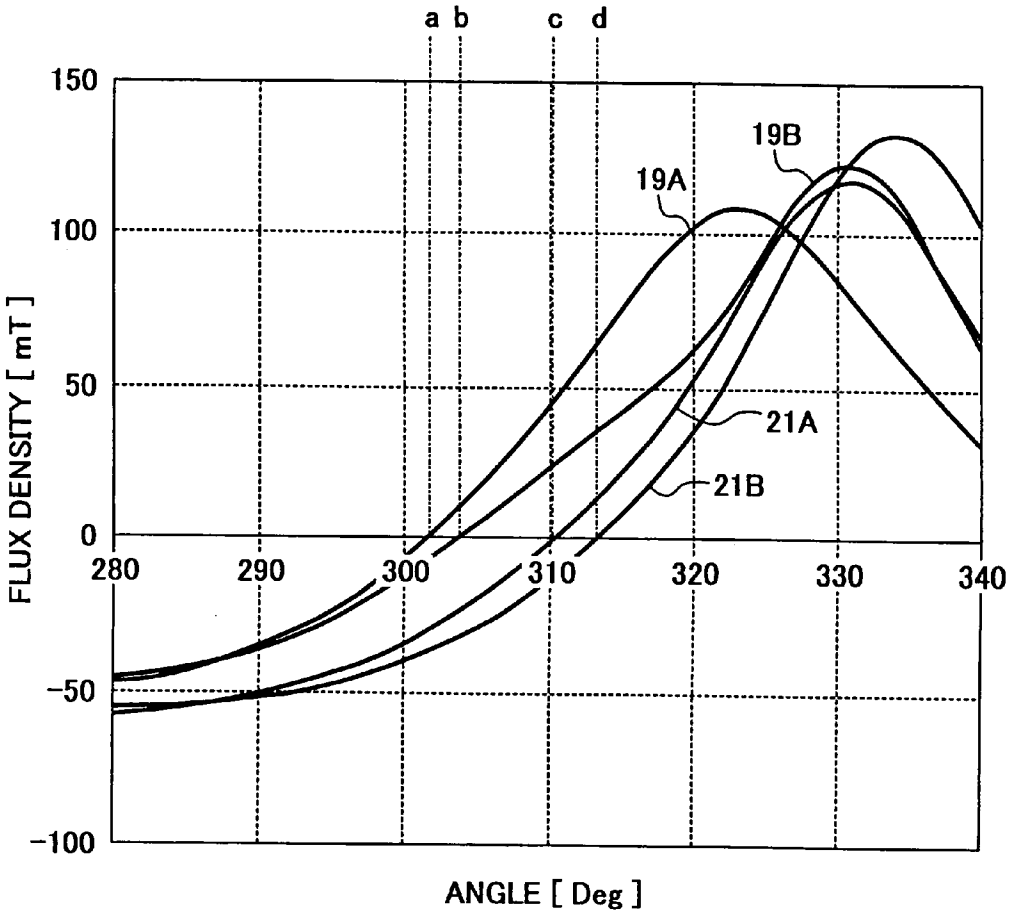

The developing roller of the comparison example 3 is an example of a developing roller near to the SLIC which has the magnetic force distribution in the normal direction as shown in FIG. 19A, and characteristics of the flux density variation rate of the pole for development shown by the curve 19(A) in FIG. 20A, and of flux density distribution of the pole for development shown by the curve 19(A) in FIG. 20B, and satisfies a condition of the flux density variation rate of 4.0 mT/Deg or more, however, has the half-value width of the flux density not less than 22°.

Figure 19B:
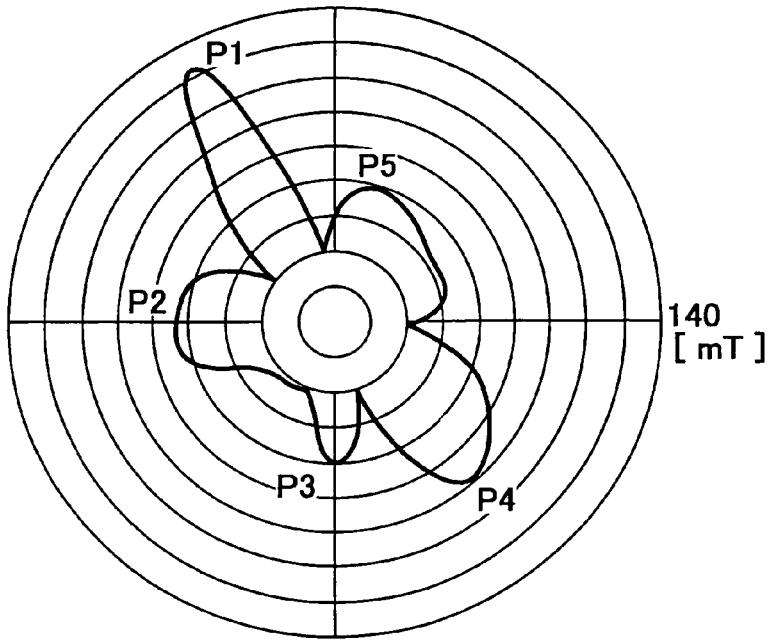

The developing roller of the comparison example 4 is an example of a developing roller which has the magnetic force distribution in the normal direction as shown in FIG. 19B, and characteristics of the flux density variation rate of the pole for development as shown by the curve 19(B) in FIG. 20A, and the flux density distribution of the pole for development as shown by the curve 19(B) in FIG. 20B, and satisfies the condition of the half-value width of the flux density of 22° or less, however, does not satisfy the condition of the flux density variation rate in the normal direction of 4.0 mT/Deg or more.

Figure 21A:
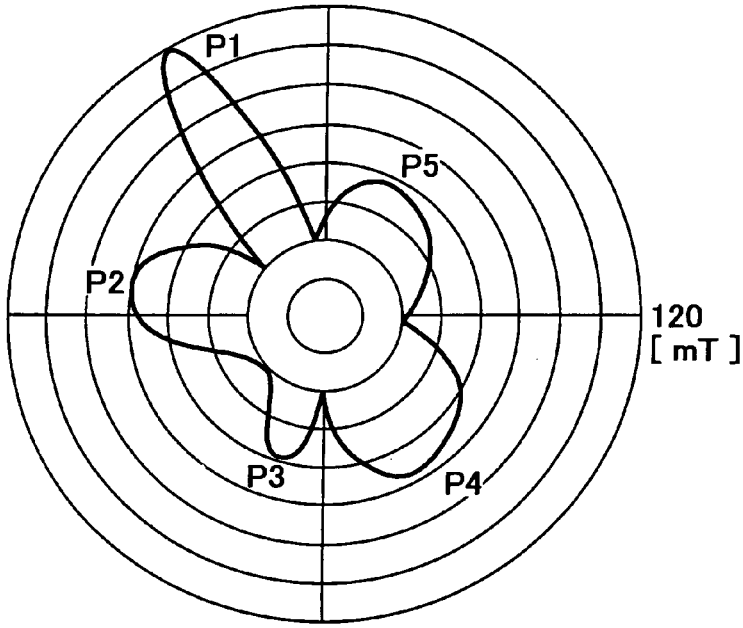
FIGS. 21A and 21B show magnet force distributions (flux density distribution) in the normal direction of the developing rollers of the embodiments 3, 4 of the present invention.

The developing roller of the embodiment 3 is an example of a developing roller which has a magnetic force distribution in the normal direction as shown in FIG. 21A, and characteristics of the flux density variation rate of the pole for development as shown by the curve 21(A) in FIG. 20A, and the flux density distribution of the pole for development as shown by the curve 21(A) in FIG. 20B, and satisfies the conditions of the half-value width of the flux density of 22° or less, and of the flux density variation rate in the normal direction of 4.0 mT/Deg or more.

Figure 21B:
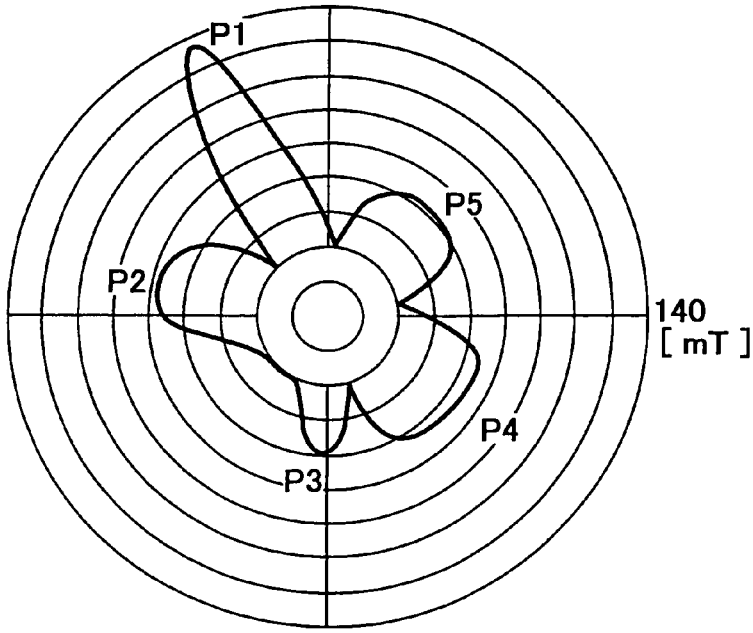

The developing roller of the embodiment 4 is an example of a developing roller which has a magnetic force distribution in the normal direction as shown in FIG. 21B, and characteristics of the flux density variation rate of the pole for development as shown by the curve 21(B) in FIG. 20A, and the flux density distribution of the pole for development as shown by the curve 21(B) in FIG. 20B, and satisfies the conditions of the half-value of width of the flux density of 22° or less, and of the flux density variation rate in the normal direction of 4.0 mT/Deg or more. Also, the developing roller of this embodiment 4 uses a rare earth-based magnet block having the maximum energy product (B Hmax) of 10 MGOe or more for the pole for development, and realizes a flux density of 133 mT.

FIG. 22 shows the evaluation result of the embodiments 3 and 4, and the comparison examples 2 to 4. The evaluation is performed in nine ranks from 1.0 to 5.0 with the rank 5.0 as the highest image quality having no carrier deposition.

As is clear from the result shown in FIG. 22, the developing device using the developing roller proposed in these embodiments 3 and 4, having the flux density variation rate of 4.0 mT/Deg or higher in the downstream side of the pole for development, provides better images than the developing device using the developing roller of the comparison examples 2 to 4 causing no carrier deposit.

By the developing roller of the embodiment 4, the best results of both the image rank and carrier depositing rank are obtained, by using the rare earth-based magnet block having the B Hmax of 10 MGOe or more for the pole for development.

Next, as the embodiment 5 of the present invention, the image evaluation was performed using a developing roller with a construction same as that of the above embodiment 4 and in the following conditions of:

developing roller diameter: Φ20 mm half-value width: 21° flux density in the normal direction: 135 mT
flux density variation rate: 4.2 mT/Deg and a developing device with the construction shown in FIG. 8, and a developer comprising polymerized toner (spherical toner) with an average particle size of 3 μm and a magnetic carrier with a diameter of 35 μm, and using, as a comparison example, crushed toner with an average particle size of 5 μm and a magnetic carrier with a diameter of 35 μm. As a result, an image rank of 5.0 with the polymerized toner (spherical toner), and 4.5 with the crushed toner were obtained.

As described above, the present invention has the following characteristics:

(1) In the developing roller as the developer carrier of the present invention, by determining the half-value of width of the flux of density and the flux density variation rate in the downstream side of the developer transporting direction from the peak magnetic force position, the magnet brush composed of the pole for development can be made narrow, dense and quick in the developer movement in its whole range, therefore, the time can be reduced for movement of the toner in the magnet brush to the developing roller side from the image carrier side when the magnet brush rubs the non-image part on the image carrier, the developing electric field can be made uniform, and the reduction in the contact probability of the developer caused by narrowing the nip for development can be supplemented, thus, a good image is obtained without the omission of the trailing edge of an image, line thinning, nor un-uniformity of dots.

(2) Since the magnet roll is of an approximately cylindrical form consisting of a plastic magnet formed by mixing the magnetic powder with a high polymer material, or rubber magnet, and constituted by magnetizing a plurality of magnetic poles including the above pole for development, a flux density pattern of the adjacent magnetic pole can be freely manufactured, compared to the magnetic roller of sticking type of all the pole blocks, while satisfying the above conditions of the flux density variation rate of the pole for development, and a low-cost developing roller can be provided.

(3) Since the above-described developing pole has a construction of the magnet block provided therein comprising a material with a larger maximum energy product (B H max) than that in the cylindrical magnet roll part, a further higher magnetic developing roller can be manufactured at a low cost, compared to the magnet roller of a sticking type of all the pole blocks. Even in a case of occurrence of dispersion in the characteristics in the magnet roll due to reasons in the course of manufacturing, the pole for development can be manufactured stably positioning its position at a desired point, by keeping the fixing position of the high magnet block constant in relation to the D cut of the core metal, which enables to provide a developing device with a high image quality and high margin of carrier deposition.

(4) The above-descried flux density distribution can be easily obtained, since the above-described magnet block is constituted to be smaller than the groove part of the approximately cylindrical magnet roll, and buried into the downstream side of the developer transporting direction in the above-described groove part. Also, the pole transition point in the upstream side can be shifted to a further upstream side by widening the space in the upstream side of the groove part in relation to the magnet block, thus optionally setting the flux density distribution necessary in the developing device.

(5) A developing roller advantageous against carrier deposition can be provided while keeping the high image quality, as the inexpensive pole for development with high magnetic force can be obtained, since the above magnet block consists of a material with the maximum energy product (B Hmax) of 10 MGOe or more (e.g. rare earth-based magnet).

(6) A developing system providing a higher image quality can be provided since the magnet brush does not rub strongly the developed toner when the magnet brush passes over the image carrier, by positioning the peak magnetic force position of the pole for development of the developing roller in the upstream side in the developer transporting direction from the position where the developer approaches closest to the image carrier as the carrier of the latent image to be developed. The magnet brush in its highest position is apart from the image carrier, and starts lowering at the closest position to the image carrier, and the magnet brush comes into contact with the image carrier slowly and uniformly, which provides a high margin of carrier deposition.

(7) A binary developer composed of the magnetic carrier and spherical toner is used as the developer, and the magnet brush of the pole for development is coated further uniformly with the toner having the spherical carrier with a small particle size, therefore, the latent images can be faithfully developed, to form images of higher quality.

(8) Images of high quality can be obtained by the process cartridge integrally equipped therein with at least the image carrier, the above-mentioned developing device, or the image carrier, charging device, the above-mentioned developing device and the cleaning device.

(9) Images of high quality can be formed by the above-mentioned developing device and the image forming apparatus equipped with the process cartridge equipped with the developing device, and excellent maintainability and recycling characteristics can be realized.

Various modifications will become possible for those skilled in their art after receiving the teachings of the present disclosure without departing from the scope thereof.

What is claimed is:

1. A developer carriers, comprising:

a developing sleeve for carrying and transporting a developer; and a magnetic roll disposed within said developing sleeve having a plurality of magnetic poles, wherein a width of a development pole forming a magnet brush to raise the developer in a developing region facing a latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferential direction is 4.0 mT/Deg or more in a part where the flux density in at least half of a downstream side of a developer carrying direction from a peak magnetic force position of said development pole is 90% or less.

2. The developer carrier as claimed in claim 1, wherein said magnet roll is roughly of a cylindrical shape comprising a plastic magnet formed by mixing magnetic powder with a high polymer material or rubber magnet and the plurality of magnetic poles, including said development pole, is magnetized thereto.

3. The developer carrier as claimed in claim 2, wherein the magnetic powder comprises a ferrite-based magnetic material, and said high polymer material comprises a high polymer compound, the high polymer compound being selected from a group consisting of a polyamide-based material, an ethylenic compound, a chlorine-based material, and a rubber material.

4. The developer carrier as claimed in claim 1, wherein said magnet roll is roughly of a cylindrical shape comprising a plastic magnet formed by mixing magnetic powder with a high polymer material or rubber magnet except for the development pole, a portion of the plurality of magnetic poles are magnetized except for said development pole, and said development pole is provided with a magnet block comprising a material having a larger maximum energy product (B Hmax) than the cylindrical magnet roll.

5. The developer carrier as claimed in claim 4, wherein said magnet block is buried in a groove part formed in the roughly cylindrical magnet roll and fixed thereto.

6. The developer carrier as claimed in claim 5, wherein said magnet block is formed smaller than the groove part of the roughly cylindrical magnet roll and is buried on a downstream side of the developer transporting direction in said groove.

7. The developer carrier as claimed in claim 4, wherein said magnet block comprises a material having a maximum energy product (B Hmax) of 10 MGOe or more.

8. The developer carrier as claimed in claim 4, wherein the magnetic powder comprises a ferrite-based magnetic material, said high polymer material comprises a high polymer compound being selected from a group consisting of a polyamide-based material, an ethylenic compound, a chlorine-based material, and a rubber material, and the magnet block comprises a plastic magnet formed by mixing a rare earth-based magnet or rare earth-based magnet powder with a second high polymer material similar to the high polymer material or a rubber magnet.

9. In a developing system for visualizing a latent image on a latent image carrier by forming a magnet brush with a developer raised on a developer carrier and by rubbing said latent image carrier with said magnet brush, said developer carrier comprising: a developing sleeve for carrying and transporting the developer; and a magnetic roll disposed within said developing sleeve having a plurality of magnetic poles, wherein a width of a development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferencial direction is 4.0 mT/Deg or more in a part where the flux density in at least half of a downstream side of a developer carrying direction from a peak magnetic force position of said development pole is 90% or less.

10. The developing system as claimed in claim 9, wherein the peak magnetic force position of the development pole of said developer carrier is positioned at an upstream side in the developer transporting direction from a position where the developer approaches closest to the latent image carrier to be developed.

11. The developing system as claimed in 9, wherein a two-component developer comprising a magnetic carrier and a spherical toner is used as the developer.

12. The developing system as claimed in claim 11, wherein a particle size of said spherical toner is 5 μm or less.

13. In a developing device equipped with a developer carrier for carrying and transporting a developer having a magnet brush with the developer raised on said developer carrier for visualizing a latent image on a latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of a development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in circumferential direction is 4.0 mT/Deg or more in a part where the flux density in at least half of a downstream side of a developer carrying direction from a peak magnetic force position of said development pole is 90% or less.

14. The developing device as claimed in claim 13, wherein the peak magnetic force position of the development pole of said developer carrier is positioned at a upstream side in the developer transporting direction from a position where the developer approaches closest to the latent image carrier to be developed.

15. The developing device as claimed in claim 13, wherein a two-component developer comprising a magnetic carrier and a spherical toner is used as the developer.

16. The developing device as claimed in claim 15, wherein a particle size of said spherical toner is 5 μm or less.

17. In a process cartridge used for an image forming part of an image forming apparatus, the process cartridge detachably installed to an apparatus main body and integrally equipped with at least a latent image carrier and a developing device therein, wherein said developing device is equipped with a developer carrier for carrying and transporting a developer having a magnet brush with the developer raised on said developer carrier for visualizing a latent image on a latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of a development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferential direction is 4.0 mT/Deg or more in a part where the flux density in at least half of a downstream side of a developer carrying direction from a peak magnetic force position of said development pole is 90% or less.

18. In a process cartridge used for an image forming part of a image forming apparatus, the process cartridge detachably installed to an apparatus main body and integrally equipped with at least a latent image carrier, a charging device for charging said latent image carrier, a developing device and a cleaning device for cleaning said latent image carrier in the cartridge, wherein said developing device is equipped with a developer carrier for carrying and transporting a developer having a magnet brush with a developer raised on said developer carrier for visualizing a latent image on a latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of the development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferential direction is 4.0 mT/Deg or more in a part where the flux density in at least a half of a downstream side of a developer carrying direction from a peak magnetic force position of said development pole is 90% or less.

19. In an image forming apparatus forming a latent image on a latent image carrier, visualizing the latent image on said latent image carrier with a developer of a developing device, then transferring an image corresponding to the latent image to a recording material, and fixing to form the image, wherein said developing device is equipped with a developer carrier for carrying and transporting the developer having a magnet brush with the developer raised on said developer carrier for visualizing the latent image on the latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of a pole development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferential direction is 4.0 mT/Deg or more in a part where the flux density in at least half of a downstream side of a developer carrying direction from a peak magnetic force position of said development pole is 90% or less.

20. In an image forming apparatus forming a latent image on a latent image carrier, visualizing the latent image on said latent image carrier by developing with a developer of a developing device, then transferring an image corresponding to the latent image to a recording material, and fixing to form the image, wherein a process cartridge is provided, and said process cartridge is used for an image forming part of the image forming apparatus, the process cartridge detachably installed to an apparatus main body and integrally equipped with at least the latent image carrier and the developing device in the cartridge, wherein said developing device is equipped with a developer carrier for carrying and transporting the developer having a magnet brush with the developer raised on said developer carrier for visualizing a latent image on a latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of a development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, a half-value width of a flux density of said development pole is 22° or less, and a flux density variation rate in a circumferential direction is 4.0 mT/Deg or more in a part where the flux density in at least half of a downstream side of a developer carrying direction from the peak magnetic force position of said development pole is 90% or less.

21. In an image forming apparatus configured to form a latent image on a latent image carrier by visualizing the latent image on said latent image carrier by developing with a developer of a developing device, then transferring an image corresponding to the latent image to a recording material, and fixing to form the image, wherein a process cartridge is provided, said process cartridge is used for an image forming part of the image forming apparatus, the process cartridge detachably installed to an apparatus main body and integrally equipped with at least the latent image carrier, a charging device for charging said latent image carrier, the developing device and a cleaning device for cleaning said latent image carrier in the cartridge, wherein said developing device is equipped with a developer carrier for carrying and transporting the developer having a magnet brush with the developer raised on said developer carrier for visualizing a latent image on a latent image carrier by rubbing said latent image carrier with said magnet brush, said developer carrier comprising:

a developing sleeve for carrying and transporting the developer; and a magnetic roll disposed within said developing sleeve having a plurality of magnetic poles, wherein a width of a development pole forming the magnet brush to raise the developer in a developing region facing the latent image carrier is narrowed, a rising region of said developer in said developing region is narrowed to realize a narrow development nip, and a flux density attenuation ratio of said development pole is 40% or more, and a half-value width of a flux density of said development pole is 22° or less, and a flux density variation rate in a circumferential direction is a 4.0 mT/Deg or more in a part where the flux density in at least half of a downstream side of a developer carrying direction from a peak magnetic force position of said development pole is 90% or less.

* * * * *